US007343752B2

(12) United States Patent
Nishiwaki

(10) Patent No.: US 7,343,752 B2
(45) Date of Patent: Mar. 18, 2008

(54) THERMOSTAT ABNORMAL STATE DETECTING APPARATUS

(75) Inventor: Nobuyuki Nishiwaki, Hyogo (JP)

(73) Assignee: Fujitsu Ten Limited, Kobe (JP)

( * ) Notice: Subject to any disclaimer, the term of this patent is extended or adjusted under 35 U.S.C. 154(b) by 501 days.

(21) Appl. No.: 10/785,075

(22) Filed: Feb. 25, 2004

(65) Prior Publication Data

US 2004/0168450 A1 Sep. 2, 2004

(30) Foreign Application Priority Data

Feb. 28, 2003 (JP) ..... 2003-054431

(51) Int. Cl.
*F25D 17/00* (2006.01)
*F01P 5/14* (2006.01)

(52) U.S. Cl. ..... 62/178; 236/34; 123/41.15

(58) Field of Classification Search ..... 62/178; 236/34, 94; 237/12.3 B; 123/41.15
See application file for complete search history.

(56) References Cited

U.S. PATENT DOCUMENTS 3,302,171 A * 1/1967 Sensing ..... 340/449
5,018,484 A * 5/1991 Naitoh ..... 123/41.12
6,082,626 A * 7/2000 Morikawa et al. ..... 237/12.3 B
6,200,021 B1 * 3/2001 Mitsutani et al. ..... 374/1
6,279,390 B1 * 8/2001 Oka et al. ..... 73/118.1
6,318,162 B1 * 11/2001 Seok ..... 73/118.1
2001/0050063 A1 * 12/2001 Niki ..... 123/41.15

FOREIGN PATENT DOCUMENTS

JP A 2000-8853 1/2000
JP A 2000-274300 10/2000

* cited by examiner

*Primary Examiner*—Marc Norman
(74) *Attorney, Agent, or Firm*—Oliff & Berridge, PLC

(57) ABSTRACT

When a temperature of cooling water detected by a water temperature sensor is, for instance, higher than, or equal to degrees, and is smaller than degrees, an abnormal state judging unit judges that an engine is under semiwarming-up condition, and then forcibly drives an electric motor fan so as to forcibly cool cooling water contained in a radiator. After the abnormal state judging unit has forcibly driven the electric motor fan, this abnormal state judging unit calculates a difference between the cooling water temperature detected by the water temperature sensor and a predicted cooling water temperature. When the calculated temperature difference is smaller than a predetermined abnormal state judging value, the abnormal state judging unit judges that a thermostat provided in a cooling water circulating path is brought into an abnormal valve opening state.

20 Claims, 7 Drawing Sheets

(FIG. 5 CONTINUED)
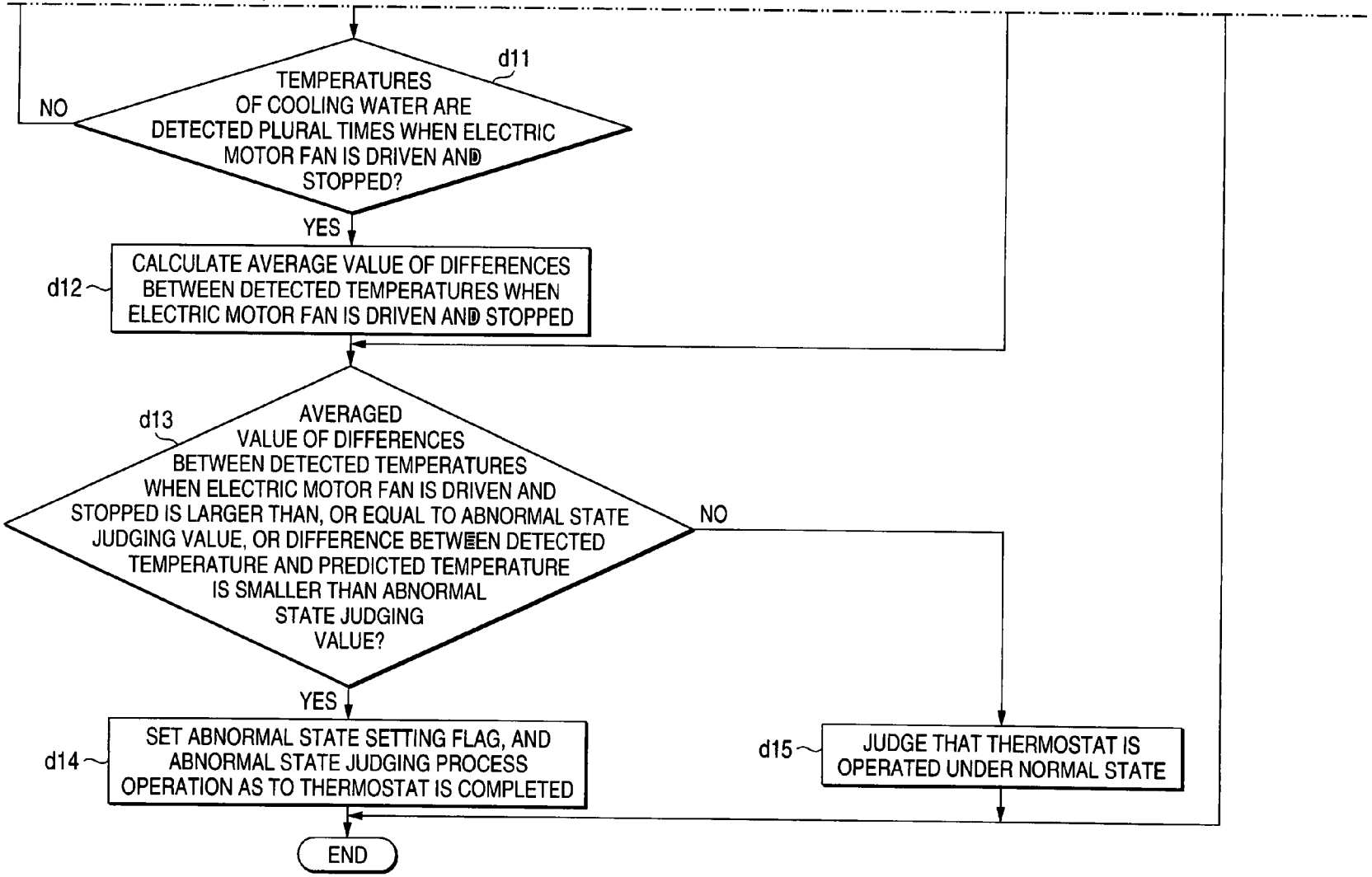

THERMOSTAT ABNORMAL STATE DETECTING APPARATUS

BACKGROUND OF THE INVENTION

1. Field of the Invention

The present invention is related to a thermostat abnormal state detecting apparatus for detecting as to whether or not an abnormal state of a thermostat occurs, which controls temperatures of cooling water of an engine.

2. Description of the Related Art

If engines whose temperatures become high are not caused to be cooled and vehicles are continuously driven for a long time duration, then these engines are brought into overheat conditions. Thus, there is such a risk that the vehicles cannot be completely driven under normal condition. As a consequence, in order to continue the normal drive operations, the temperatures of these engines must be sufficiently cooled. However, when the engines are excessively cooled, gasoline contained in mixed gas cannot be sufficiently vaporized, and thus, combustion conditions are deteriorated, which may cause harmful gas such as hydrocarbon (abbreviated as "HC") and carbon monoxide (abbreviated as "CO") to be increased, and also may cause environmental deteriorations. As a result, cooling apparatus capable of maintaining engines of vehicles at proper temperatures are installed on these engines.

FIG. 7 is a diagram for indicating a simplified arrangement of a conventional cooling apparatus 30. The cooling apparatus 30 is arranged by containing a radiator 31, a cooling fan 32, a thermostat 33, a water pump 34, a cooling water circulating path 35, and a pipe path 36. It should be noted that arrows shown in this drawing indicate directions along which cooling water flow. The radiator 31 corresponds to an apparatus for cooling the cooling water. The cooling fan 32 blows wind with respect to the radiator 31 so as to emphasize cooling effects of the cooling water contained in the radiator 31. The thermostat 33 switches operations as to whether or not the cooling water derived from the radiator 31 may be supplied to an engine 37 of a vehicle in response to temperatures. The water pump 34 circulates the cooling water.

When the engine 37 is started, since the temperature of the cooling water contained in the engine 37 is cold, the valve of the thermostat 33 is closed, so that the cooling water does not flow into the radiator 31, but is circulated through the bypass path 36, and is returned to the engine 37 by the water pump 34. Also, when the temperature of the cooling water is increased up to a predetermined valve opening temperature of the thermostat 33 while the vehicle is traveled, the valve of this thermostat 33 is opened, so that the cooling water which is located on the side of the engine 37 and has been heated passes through the cooling water circulating path 35 communicated between the engine 37 and the radiator 31, and then is entered into the radiator 31. When the cooling fan 32 is provided at a position opposite to the radiator 31, the cooling water contained in the radiator 31 is radiated to be cooled by wind blown from the cooling fan 32. The cooled cooling water contained in the radiator 31 is returned via the cooling water circulating path 35 to the engine 37 by the water pump 34. As previously explained, the high temperature of the engine 37 may be cooled to the proper temperature by the cooling apparatus 30.

However, when the engine 37 is driven under warming-up operation after this engine 37 has been started, in such a case that the thermostat 33 is brought into an abnormal state and thus such a condition that the valve of this thermostat 33 is kept opened and is not closed is continued, the cooling water which is circulated in the cooling water circulating path 35 is cooled by the radiator 31. As a result, the time required that the temperature of this cooling water is reached to the proper temperature is delayed, and therefore, a lengthy time period is required until the engine 37 is warmed. As a consequence, when the above-described abnormal state happens to occur in the thermostat 33, this abnormal state must be immediately detected and a warning sign must be indicated to a vehicle driver.

A first conventional radiator malfunction sensing apparatus for sensing an abnormal state of a thermostat calculates a predicted water temperature based upon a thermal load parameter which is correlative to an increase of water temperatures and a water temperature when an engine is started, and also detects an actual water temperature. Both in the case that the predicted water temperature is reached to a predetermined malfunction judging value and the detected actual water temperature is not reached to a predetermined normal state judging value, this radiator malfunction sensing apparatus judges that the thermostat of the radiator is brought into a malfunction state (see, for example, JP-A-2000-8853).

A second conventional vehicle-oriented electronic control apparatus judges as to whether or not an abnormal state of a thermostat based upon a temperature change in cooling water of an engine only just after the engine whose temperature is cold is started. Concretely speaking, if a valve opening failure happens to occur under which a valve of the thermostat is kept opened, then the cooling water is circulated even when the engine whose temperature is cold is started, so that temperature increasing of the cooling water contained in the engine is disturbed. As a consequence, in the second conventional electronic control apparatus, a gradient indicative of an increasing degree of the cooling water temperatures is detected, and since this detected gradient is compared with a gradient of a cooling water temperature under normal operation, this electronic control apparatus judges as to whether or not the valve opening failure of the thermostat happens to occur (see, for example, JP-A-2000-274300).

In the first and second prior art, since the abnormal state detecting process operations for the thermostat are carried out from the ordinary temperature state, or from the lower temperature state than the ordinary temperature state, the abnormal states of the thermostats can be detected. However, in the first and second prior art, even when the abnormal state detecting process operation as to the thermostat is carried out from a semiwarming-up state whose temperature is higher than the ordinary temperature, increasing time of the cooling water temperature which requires that the engine state becomes the warming-up state from the semiwarming-up state is shorter than such an increasing time of the cooling water temperature which requires that the engine state becomes the warming-up state from the starting state, so that the characteristic indicative of the abnormal state of the thermostat cannot be completely grasped. As a consequence, the first and second prior art own such a problem that the abnormal states of the thermostats can be hardly detected from the semiwarming-up states.

SUMMARY OF THE INVENTION

An object of the present invention is to provide such a thermostat abnormal state detecting apparatus capable of readily detecting an abnormal state of a thermostat in relatively high precision even under a semiwarming-up state.

A thermostat abnormal state detecting apparatus, according to the present invention, is featured by such a thermostat abnormal state detecting apparatus for detecting an abnormal state of a thermostat which is provided in a circulating path for cooling water within an engine based upon both a detected cooling water temperature and a cooling water temperature predicted by a driving condition of the engine, wherein when a cooling water temperature detected while a predicting operation of the cooling water temperature is commenced satisfies a predetermined temperature condition, an electric motor fan for blowing wind with respect to the circulating path is driven.

In accordance with the present invention, when the cooling water temperature detected while the cooing water temperature is started to be predicted can satisfy the predetermined temperature condition (for example, cooling water temperature is higher than ordinary temperature, namely higher than, or equal to 40 degrees and lower than 50 degrees), the thermostat abnormal state detecting apparatus judges that the engine is under the semiwarming-up state, and drives the electric motor fan. As a result, the electric motor fan blows wind to the circulating path for the cooling water so as to cool the cooling water contained in the circulating path. When the electric motor fan is driven, if the thermostat is under, for instance, an abnormal valve opening state, then the valve of this thermostat is brought into an open state, and thus, the cooling water cooled by the electric motor fan is circulated within the circulating path. As a result, the increasing degree of the detected cooling water temperature becomes gently, as compared with such a case that the thermostat is operated under the normal state, and further, the valve of this thermostat is closed.

As a consequence, since the electric motor fan is driven, the increasing degree of the detected cooling water temperature becomes largely different from the increasing degree of the predicted cooling water temperature, so that the difference between the temperature increasing degrees obtained when the thermostat is operated under normal state and also under abnormal state can become clear. As a consequence, the abnormal state judging unit only judges that the engine is under the semiwarming-up state, when the cooling water temperature detected while the prediction of the cooling water temperature is commenced may satisfy a predetermined temperature condition, and also merely judges as to whether or not the detected cooling water temperature is gradually increased, so that this abnormal judging unit can judge as to whether or not the thermostat is under the abnormal valve opening state. Accordingly, the abnormal state judging unit may readily detect the abnormal state of the thermostat even under the semiwarming-up state.

Also, a thermostat abnormal state detecting apparatus, according to the present invention, is featured by such a thermostat abnormal state detecting apparatus for detecting an abnormal state of a thermostat which is provided in a circulating path for cooling water within an engine based upon both a detected cooling water temperature and a cooling water temperature predicted by a driving condition of the engine, wherein in such a case that it is so judged that detection precision achieved when the abnormal state detecting operation is carried out is low, under such a condition that an electric motor fan for blowing wind with respect to the circulating path is driven, the abnormal state detecting operation as to the thermostat is carried out based upon both the detected cooling water temperature and the cooling water temperature predicted by the driving condition of the engine.

In accordance with the present invention, in such a case that it is so judged that detection precision achieved when the abnormal state detecting operation is carried out is low, under such a condition that an electric motor fan for blowing wind with respect to the circulating path is driven, the abnormal state detecting operation as to the thermostat is carried out based upon both the detected cooling water temperature and the cooling water temperature predicted by the driving condition of the engine. The abnormal state detecting operation of the thermostat is carried out as follows. That is, for instance, this detecting operation is carried out by calculating a difference between the detected cooling water temperature and the predicted cooling water temperature. When the calculated temperature difference is smaller than the predetermined value, the thermostat abnormal state detecting apparatus judges that the thermostat is under the abnormal valve opening state. As previously explained, the difference between the cooling water temperature detected under such a condition that the electric motor fan is driven and the predicted cooling water temperature becomes large, and thus, the difference between the temperature increasing degrees obtained when the thermostat is operated under normal state and also under abnormal state may become clear. As a consequence, in such a case that it is so judged that the detection precision for detecting the abnormal state of the thermostat is low, since the abnormal state is detected under such a condition that the electric motor fan is driven, the abnormal state of the thermostat can be detected in the relatively high precision.

Also, the present invention is featured by that such a case that it is so judged that the detection precision is low corresponds to a case that a time period defined by that the cooling water temperature is reached to a predetermined temperature after the abnormal state detecting operation has been commenced is shorter than, or equal to a predetermined time period.

In accordance with the present invention, such a case that it is so judged that the detection precision is low corresponds to a case that a time period defined by that the cooling water temperature is reached to a predetermined temperature after the abnormal state detecting operation has been commenced is shorter than, or equal to a predetermined time period, while this time period implies that, for example, the temperature of the cooling water is increased up to the valve opening temperature of the thermostat. When the time period defined by that the cooling water temperature is increased up to the valve opening temperature of the thermostat is shorter than, or equal to the predetermined time period, the characteristic indicative of the abnormal state of the thermostat cannot be perfectly grasped, so that the detection precision achieved in the abnormal state detecting operation of the thermostat is lowered. As a consequence, as previously explained, in such a case that the time period during which the cooling water temperature is reached to the predetermined temperature after the abnormal state detecting operation has been commenced is shorter than, or equal to the predetermined time, the abnormal state is again detected under such a condition that the electric motor fan is driven. As a result, the detecting precision can be improved, and the abnormal state of the thermostat can be detected in the relatively high precision.

Also, the present invention is featured by that a temperature gradient of the detected cooling water temperature is calculated based upon a temporal change in the detected cooling water temperature; a temperature gradient of the predicted cooling water temperature is calculated based upon a temporal change in the predicted cooling water temperature; a difference between the calculated temperature gradients is calculated; and when the calculated difference between the temperature gradients is smaller than a predetermined value, the thermostat abnormal state detecting apparatus judges that the thermostat is brought into an abnormal valve opening state.

In accordance with the present invention, when the cooling water temperature detected while the cooling water temperature is started to be predicted can satisfy the predetermined temperature condition (for instance, cooling water temperature is higher than the ordinary temperature, namely higher than, or equal to 40 degrees and lower than 50 degrees), the thermostat abnormal state detecting apparatus judges that the engine is under the semiwarming-up state, and drives the electric motor fan. As a result, the electric motor fan blows wind to the circulating path for the cooling water so as to cool the cooling water contained in the circulating path. As previously explained, after the electric motor fan has been driven, the judgement as to whether or not the thermostat is brought into the abnormal valve opening state is carried out. The judgement as to whether or not the thermostat is brought into the abnormal valve opening state is performed as follows: That is, the temperature gradient of the detected cooling water temperature is calculated based upon the temporal change in the detected cooling water temperature; the temperature gradient of the predicted cooling water temperature is calculated based upon the temporal change in the predicted cooling water temperature; the difference between the calculated temperature gradients is calculated, then, when the calculated difference between the temperature gradients is smaller than the predetermined value, the thermostat abnormal state detecting apparatus judges that the thermostat is brought into the abnormal valve opening state.

As previously explained, if the difference between the temperature gradient of the detected cooling water temperature and the temperature gradient of the predicted cooling water temperature is calculated by driving the electric motor fan, then the difference between the temperature gradients becomes large. Thus, the differences between the temperature gradients calculated when the thermostat is operated under normal operation and abnormal operation can become clear. As a consequence, when the cooling water temperature detected while the predicting operation of the cooling water temperature is commenced can satisfy the predetermined temperature condition, the abnormal state judging unit only judges that the engine is under the semiwarming-up state, and merely judges as to whether or not the difference the temperature gradient of the detected cooling water temperature and the temperature gradient of the predicted cooling water temperature is smaller than the predetermined abnormal state judging value, so that this abnormal judging unit can judge as to whether or not the thermostat is under the abnormal valve opening state. Accordingly, the abnormal state judging unit may readily detect the abnormal state of the thermostat even under the semiwarming-up state.

Also, the present invention is featured by that an averaged value of differences between the detected cooling water temperatures and the predicted cooling water temperatures is calculated; and when the calculated averaged value is smaller than a predetermined value, the thermostat abnormal state detecting apparatus judges that the thermostat is brought into an abnormal valve opening state.

In accordance with the present invention, when the cooling water temperature detected while the cooling water temperature is started to be predicted can satisfy the predetermined temperature condition (for instance, cooling water temperature is higher than the ordinary temperature, namely higher than, or equal to 40 degrees and lower than 50 degrees), the thermostat abnormal state detecting apparatus judges that the engine is under the semiwarming-up state, and drives the electric motor fan. As a result, the electric motor fan blows wind to the circulating path for the cooling water so as to cool the cooling water contained in the circulating path. As previously explained, after the electric motor fan has been driven, the judgement as to whether or not the thermostat is brought into the abnormal valve opening state is carried out. The judgement as to whether or not the thermostat is brought into the abnormal valve opening state is performed as follows: That is, the difference between the detected cooling water temperature and the predicted cooling water temperature is repeatedly calculated plural times every predetermined time, and then, the averaged value of the calculated plural temperature differences is calculated. Then, when the calculated averaged value is smaller than a predetermined value, the thermostat abnormal state detecting apparatus judges that the thermostat is brought into an abnormal valve opening state.

As previously described, the difference between the detected cooling water temperature and the predicted cooling water temperature is repeatedly calculated plural times, the averaged value of these calculated temperature differences is calculated, and then, the abnormal state detecting operation of the thermostat is carried out by comparing the averaged value of the temperature difference with the predetermined value. As a consequence, the abnormal state of the thermostat can be detected in the relatively high precision, as compared with such a case that only one of the differences between the detected cooling water temperatures and the predicted cooling water temperatures is calculated, and then, this one calculated temperature difference is compared with the predetermined value.

Also, the present invention is featured by that a temperature gradient of the detected cooling water temperature is calculated based upon a temporal change in the detected cooling water temperature; a temperature gradient of the predicted cooling water temperature is calculated based upon a temporal change in the predicted cooling water temperature; an averaged value of differences between the calculated temperature gradients is calculated; and when the calculated averaged value of the differences between the temperature gradients is smaller than a predetermined value, the thermostat abnormal state detecting apparatus judges that the thermostat is brought into an abnormal valve opening state.

In accordance with the present invention, when the cooling water temperature detected while the cooling water temperature is started to be predicted can satisfy the predetermined temperature condition (for instance, cooling water temperature is higher than the ordinary temperature, namely higher than, or equal to 40 degrees and lower than 50 degrees), the thermostat abnormal state detecting apparatus judges that the engine is under the semiwarming-up state, and drives the electric motor fan. As a result, the electric motor fan blows wind to the circulating path for the cooling water so as to cool the cooling water contained in the circulating path. As previously explained, after the electric motor fan has been driven, the judgement as to whether or not the thermostat is brought into the abnormal valve opening state is carried out. The judgement as to whether or not the thermostat is brought into the abnormal valve opening state is performed as follows: That is, the temperature gradient of the detected cooling water temperature is calculated based upon the temporal change in the detected cooling water temperature; the temperature gradient of the predicted cooling water temperature is calculated based upon the temporal change in the predicted cooling water temperature; and then, a difference between the respective temperature gradients is repeatedly calculated plural times every predetermined time, and an averaged value of the differences between the calculated plural temperature gradients is calculated. Then, when the calculated averaged value of the differences between the temperature gradients is smaller than a predetermined value, the thermostat abnormal state detecting apparatus judges that the thermostat is brought into an abnormal valve opening state.

As previously described, the difference between the temperature gradient of the detected cooling water temperature and the temperature gradient of the predicted cooling water temperature is repeatedly calculated plural times, the averaged value of these calculated temperature gradients is calculated, and then the abnormal state detecting operation of the thermostat is carried out by comparing the averaged value of the differences between the temperature gradients with the predetermined value. As a consequence, the abnormal state of the thermostat can be detected in the relatively high precision, as compared with such a case that only one of the differences between the temperature gradients of the detected cooling water temperatures and the temperature gradients of the predicted cooling water temperatures is calculated, and then, this one calculated temperature gradient difference is compared with the predetermined value.

Also, the present invention is featured by that after the electric motor fan has been driven in an intermittent manner under a predetermined condition, the thermostat abnormal state detecting apparatus judges as to whether or not the thermostat is under an abnormal valve opening state.

In accordance with the present invention, when the cooling water temperature detected while the cooling water temperature is started to be predicted can satisfy the predetermined temperature condition (for instance, cooling water temperature is higher than the ordinary temperature, namely higher than, or equal to 40 degrees and lower than 50 degrees), the thermostat abnormal state detecting apparatus judges that the engine is under the semiwarming-up state, and drives the electric motor fan in the intermittent manner under the predetermined condition. For instance, after the electric motor fan has been driven only for a predetermined time period, the electric motor fan is stopped only for a predetermined time period. As previously explained, after the electric motor fan has been intermittently driven under the preselected condition, the abnormal state judging apparatus judges a to whether or not the thermostat is under an abnormal valve opening state. The judgement as to whether or not the thermostat is under the abnormal valve opening state is carried out as follows: For instance, a calculation is made of a difference between the cooling water temperature when the electric motor fan is driven and the cooling water temperature when the electric motor fan is stopped, and then, when the calculated temperature difference is larger than, or equal to the predetermined value, the abnormal state judging apparatus judges that the thermostat is under the abnormal valve opening state.

As previously explained, when the electric motor 12 is driven in the intermittent manner under the predetermined condition, if the thermostat is operated under normal condition, then there is no large change in the increasing degrees of the detected temperatures irrespective of driving operation, or stopping operation of the electric motor fan. However, when the thermostat is under the abnormal valve opening state, an increasing degree of a detected temperature when the electric motor fan is driven is largely different from an increasing degree of a detected temperature when the electric motor fan is stopped. As a consequence, when the electric motor fan is driven in the intermittent manner under the predetermined condition, the abnormal state of the thermostat can be detected in relatively high precision, as compared with such a case that the electric motor is merely driven for a predetermined time period. Also, since the electric motor fan is intermittently driven under the predetermined condition, the abnormal state judging unit may readily detect the abnormal state of the thermostat even under the semiwarming-up state.

Also, the present invention is featured by that when the cooling water temperature detected while the engine is started satisfies sid predetermined temperature condition, the thermostat abnormal state judging apparatus judges as to whether or not the thermostat is under the abnormal valve opening state after a predetermined time has elapsed.

In accordance with the present invention, when the cooling water temperature detected while the cooling water temperature is started to be predicted can satisfy the predetermined temperature condition (for instance, cooling water temperature is higher than the ordinary temperature, namely higher than, or equal to 40 degrees and lower than 50 degrees), the thermostat abnormal state detecting apparatus judges that the engine is under the semiwarming-up state, and also judges as to whether or not the thermostat is brought into the abnormal valve opening state after a predetermined time period has elapsed. As this predetermined time period, such a time period is set which requires that, for example, cooling water is circulated through a circulating path one time, which connects an engine side to a radiator side. After this predetermined time period has elapsed, for example, after the electric motor fan has been driven under a predetermined condition, the thermostat abnormal state judging apparatus judges as to whether or not the thermostat is brought into the abnormal valve opening state. When the engine is started, there is a difference between the cooling water temperature contained in the circulating path of the engine side and the cooling water temperature contained in the circulating path of the radiator side. As previously explained, since the execution of the abnormal state judging process operation of the thermostat is brought into the waiting state until the predetermined time has elapsed, both the cooling water present on the engine side and the cooling water present on the radiator side are circulated, so that the cooling water temperature within the circulating path can be maintained at a constant temperature. As a consequence, the abnormal state of the thermostat can be detected in the relative high precision, as compared with such a case that the abnormal state of the thermostat is detected under such a condition that there is a difference between the cooling water temperature within the engine-sided circulating path and the cooling water temperature within the radiator-sided circulating path before the predetermined time has passed.

Also, the present invention is featured by that a rotation speed of the electric motor fan is changed in response to the driving condition of the engine.

In accordance with the present invention, when the cooling water temperature detected while the cooling water temperature is started to be predicted can satisfy the predetermined temperature condition (for instance, cooling water temperature is higher than the ordinary temperature, namely higher than, or equal to 40 degrees and lower than 50 degrees), the thermostat abnormal state detecting apparatus judges that the engine is under the semiwarming-up state, and changes the rotation speed of the electric motor fan in response to the driving condition of the engine, for instance, a traveling speed of a vehicle. When the vehicle is traveled in a high speed, since a wind amount is large which is received along the traveling direction of the vehicle, the rotation speed of the electric motor fan is decreased, whereas when the vehicle is traveled in a low speed, since a wind amount is small which is received along the traveling direction of the vehicle, the rotation speed of the electric motor fan is increased to drive this electric motor fan at this increased rotation speed. Also, when the vehicle is stopped, since there is no wind amount produced by traveling the vehicle, the rotation speed of the electric motor fan is increased. Further, since a battery is not recharged by traveling the vehicle, the drive duty is set to 50% and then the electric motor fan is driven.

As previously explained, since the rotation speed of the electric motor fan is varied in response to the traveling speed of the vehicle, the electric load given to the electric motor fan, for example, the load given to the battery can be reduced.

Also, the present invention is featured by that the electric motor fan blows wind with respect to a radiator which is provided in the circulating path.

In accordance with the present invention, the electric motor fan blows the wind with respect to the radiator which is provided in the circulating path. As explained above, since the electric motor fan blows wind with respect to the radiator, the heat radiating effect of the radiator can be increased, so that cooling effects achieved by the cooling water contained in the radiator may be emphasized. As a consequence, the cooling effects as to the entire cooling water which is circulated through the circulating path can be emphasized.

BRIEF DESCRIPTION OF THE DRAWINGS

These and other objects and advantages of this invention will become more fully apparent from the following detailed description taken with the accompanying drawings in which.

DETAILED DESCRIPTION OF THE PREFERRED EMBODIMENTS

Figure 1:
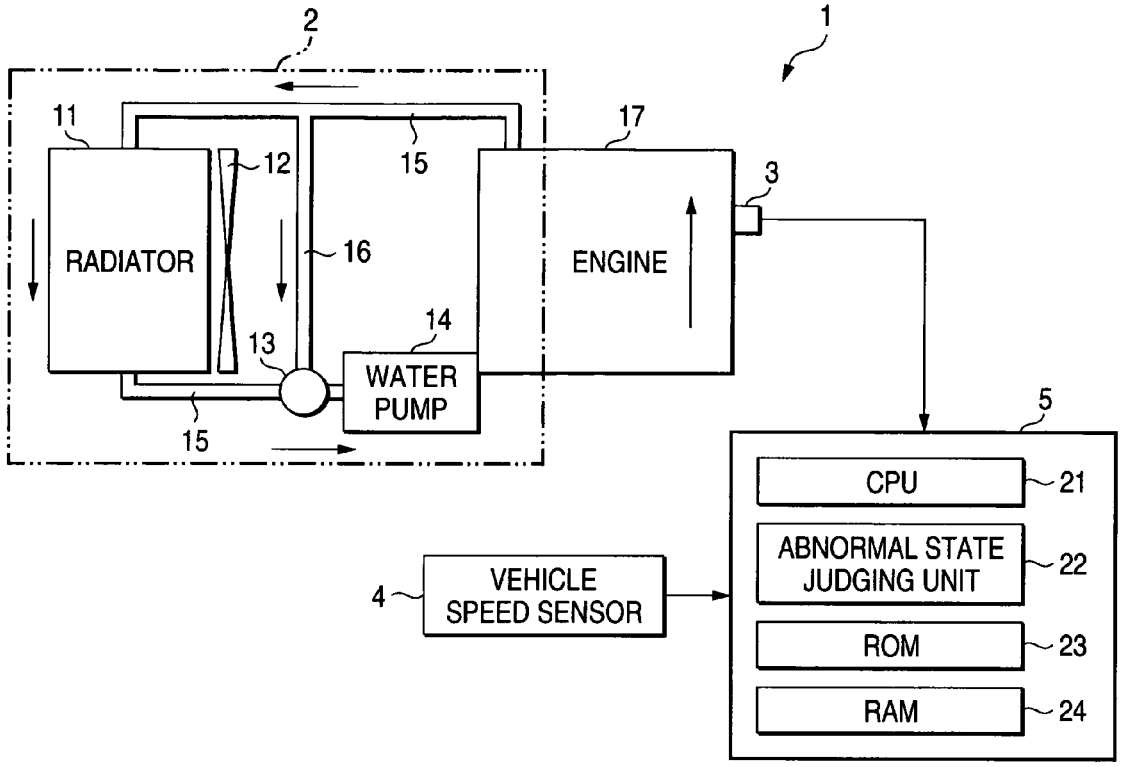
FIG. 1 is a diagram for indicating a simplified arrangement of a thermostat abnormal state detecting apparatus according to an embodiment of the present invention.

FIG. 1 is a diagram for showing a simplified construction of a thermostat abnormal state detecting apparatus 1 according to an embodiment of the present invention. The thermostat abnormal state detecting apparatus 1 is arranged by containing a cooling unit 2, a water temperature sensor 3, a vehicle speed sensor 4, and an electronic control unit (abbreviated as "ECU" hereinafter) 5. The cooling unit 2 is constituted by containing a radiator 11, an electric motor fan 12, a thermostat 13, a water pump 14, a cooling water circulating path 15, and a bypass path 16.

The radiator 11 corresponds to such an apparatus which is provided in the cooling water circulating path 15 so as to cool cooling water which has absorbed heat. The cooling water circulating path 15 is communicated between the engine 17 and this radiator 11. While a vehicle is driven, the cooling water contained in the radiator 11 is cooled by wind which is received along a travel direction of the vehicle, and also the cooling water contained in the radiator 11 is forcibly cooled by wind fed from the electric motor fan 12 (will be explained later).

The electric motor fan 12 blows wind with respect to the cooling water circulating path 15 so as to cool the cooling water contained in this cooling water circulating path 15. Also, the electric motor fan 12 blows wind with respect to the radiator 11 in order to increase the heat radiating effect of the radiator 11, so that cooling effects achieved by the cooling water contained in the radiator 11 may be emphasized.

The thermostat 13 is provided in the cooling water circulating path 15, and switches whether or not the cooling water supplied from the radiator 11 may flow into the engine 17 of the vehicle in such a manner that a valve is automatically opened/closed in response to temperatures of the cooling water in order to keep the temperatures of the cooling water at a proper temperature.

The water pump 14 corresponds to such a pump which circulates the cooling water, and is rotated by receiving power of the engine 17. Since the water pump 14 is rotated, both the cooling water which has passed through the bypass path 16 and the cooling water which has passed through the radiator 11 and the cooling water circulating path 15 are again supplied to the engine 17.

When the engine 17 starts, the cooling water contained in the engine 17 is cold, so that the valve of the thermostat 13 is closed, the cold cooling water does not flow into the radiator 11, but is circulated within both the cooling water circulating path 15 and the bypass path 16, which are provided in the vicinity of the engine 17, and then is returned to the side of the engine 17 by the water pump 14. As a result, since the cooled cooling water contained in the radiator 11 is not supplied to the side of the engine 17, this engine 17 can be quickly warmed up, so that fuel consumption can be improved and harmful exhaust gas such as HC and CO can be reduced. Also, when a temperature of cooling water is reached to a predetermined injection-valve opening temperature of the thermostat 13, for example, this temperature is increased up to 80 degrees while the vehicle is driven, the injection-valve of the thermostat 13 is opened, so that the cooling water present on the side of the engine 17 passes through the cooling water circulating path 15 communicated between the thermostat 13 and the engine 17, and then enters into the radiator 11. While the electric motor fan 12 is provided at a position opposite to the radiator 11, the cooling water contained in the radiator 11 is thermally radiated so as to be cooled by both the wind blown by this electric motor fan 12 and the wind which is received along the travel direction of the vehicle. The cooled cooling water contained in the radiator 11 passes through the cooling water circulating path 15, and then is returned to the engine 17 by the water pump 14. As previously explained, the engine 17 whose temperature has been reached to the high temperature is cooled by the cooling unit 2 until this high engine temperature becomes a proper temperature. As a consequence, it is possible to avoid that the engine 17 is brought into an overheat state.

The water temperature sensor 3 is provided on a cylinder block which constitutes the engine 17 so as to detect a temperature of cooling water within the engine 17. It should be noted that the setting position of the water temperature 3 is not limited only to the position indicated in FIG. 1, but may be selected to be such a position closer to the engine 17 than the position where the thermostat 13 is installed. Also, a water temperature signal is outputted from the water temperature sensor 3, and this water temperature signal is acquired by the ECU 5 (will be explained later). The vehicle speed sensor 4 senses drive speeds (will be simply referred to as "vehicle speed" hereinafter, if required) of the vehicle. A vehicle speed signal is outputted from the vehicle speed sensor 4, and then, this outputted vehicle speed signal is acquired by the ECU 5 (will be explained later). As to both the water temperature speed and the vehicle speed signal, which have been acquired, a signal processing operation such as an A/D (analog-to-digital) converting operation is carried out, and these processed signals are employed in the case that an abnormal state detecting process operation as to the thermostat 13 is carried out.

The ECU 5 is constructed by employing a CPU (Central Processing Unit) 21, an abnormal state judging unit 22, a ROM (Read-Only Memory) 23, and a RAM (Random Access Memory) 24. The CPU (Central Processing Unit) 21 executes various programs which have been stored in the ROM 23 (will be explained later). In response to a temperature of cooling water sensed by the water temperature sensor 3, the abnormal state judging unit 22 drives the electric motor fan 12 when this cooling water temperature becomes higher than, or equal to a predetermined temperature, and stops the electric motor fan 12 when this cooling water temperature becomes lower than the predetermined temperature. Also, the abnormal state judging unit 22 lowers the rotation speed of the electric motor fan 12 when the vehicle is driven in a high speed, and increases the rotation speed of this electric motor fan 12 when the vehicle is driven in a low speed and is stopped in response to a drive state of the engine 17, for example, a drive speed of the vehicle. Also, the abnormal state judging unit 22 judges as to whether or not the thermostat 13 is brought into an abnormal valve opening state.

The ROM 23 has previously stored thereinto a control program of the engine 17, a program for judging an abnormal state of the thermostat 13, a program for predicting a temperature of cooling water, and a program for calculating a difference between a cooling water temperature (will simply referred to as "detected temperature" hereinafter, if necessary) detected by the water temperature sensor 3 and another cooling water temperature (will be simply referred to an "predicted temperature" hereinafter, if necessary) which is predicted based upon a drive condition of the engine 17. Also, the ROM 23 has previously stored thereinto a program for calculating an averaged value of differences between the detected temperatures and the predicted temperatures, a program for calculating a temperature gradient of detected temperatures based upon a temporal change of the detected temperatures, a program for calculating a temperature gradient of predicted temperatures based upon a temporal change of the predicted temperatures, a program for calculating a difference between the temperature gradient of the detected temperatures and the temperature gradient of the predicted temperatures, and a program for calculating an averaged value of differences between the temperature gradients of the detected temperatures and the temperature gradients of the predicted temperatures, and also, a table (will also be expressed as "duty map" hereinafter, if necessary) in which vehicle speeds are related to drive duties indicative of rotation speeds of the electric motor fan 12 in response to the vehicle speeds.

The RAM 24 stores thereinto results obtained by executing the respective programs which have been stored in the ROM 23 by the CPU 21, and results of abnormal state judgments of the thermostat 13. Also, the RAM 24 stores thereinto a semiwarming-up state flag, a state flag other than the semiwarming-up state, and an abnormal state judging flag. A semiwarming-up state of this embodiment implies such a state that a detected temperature is higher than, or equal to 40 degrees, and lower than 50 degrees, namely higher than the ordinary temperature. It should be noted that the cooling water temperature used to judge that the present state is the semiwarming-up state may be alternatively selected from any other temperatures than the above-described cooling water temperature.

Figure 2:
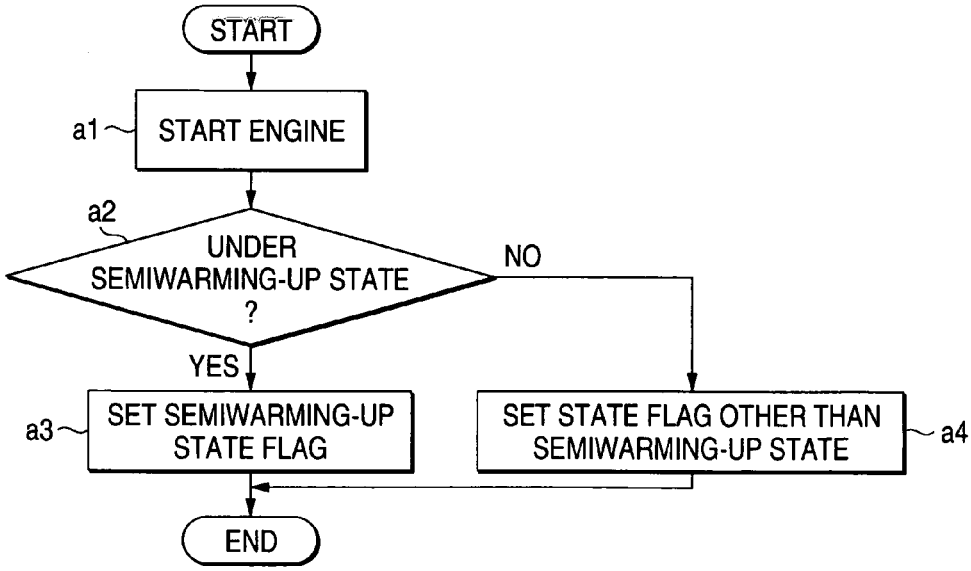
FIG. 2 is a flow chart for describing an example of a preprocessing operation involved in an abnormal state detecting process operation as to a thermostat 13.

FIG. 2 is a flow chart for describing an example of a preprocessing operation contained in an abnormal state detecting process operation as to the thermostat 13. In a step al, a power switch of the engine 17 is turned ON so as to start the engine 17. In a step a2, a check is made as to whether or not the engine 17 is under semiwarming-up state. Concretely speaking, a judgment is made as to whether or not a temperature detected by the water temperature sensor 3 is equal to a predetermined temperature, for example, becomes higher than, or equal to 40 degrees, and lower than 50 degrees in this embodiment. When the detected temperature is higher than, or equal to 40 degrees, and lower than 50 degrees, it is so judged that the engine 17 is under semiwarming-up state. In the step a2, when it is so judged that the engine 17 is brought into the semiwarming-up state, the preprocessing operation is advanced to a step a3. To the contrary, when it is so judged that the engine 17 is not under the semiwarming-up state, the preprocess operation is advanced to a step a4.

In the step a3, the semiwarming-up state flag, for example, "1" is set in this embodiment, and then, this flag "1" is stored in the RAM 24. In the step a4, as the state flag other than the semiwarming-up state, for instance, "0" is set in this embodiment, and then, this flag "0" is stored in the RAM 24.

Figure 4:
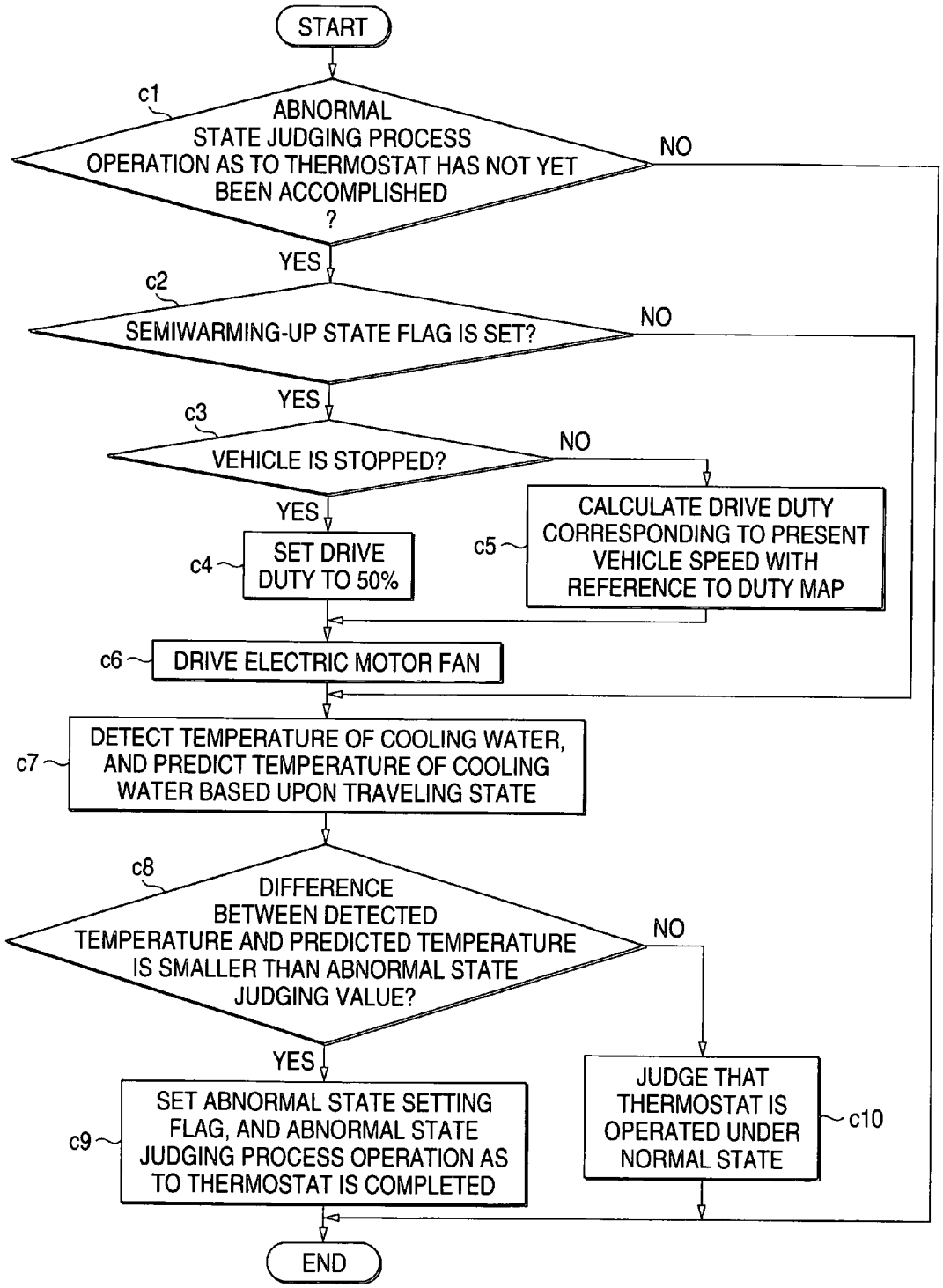
FIG. 4 is a flow chart for explaining an example of another abnormal state detecting process operation as to the thermostat 13.
Figure 5:
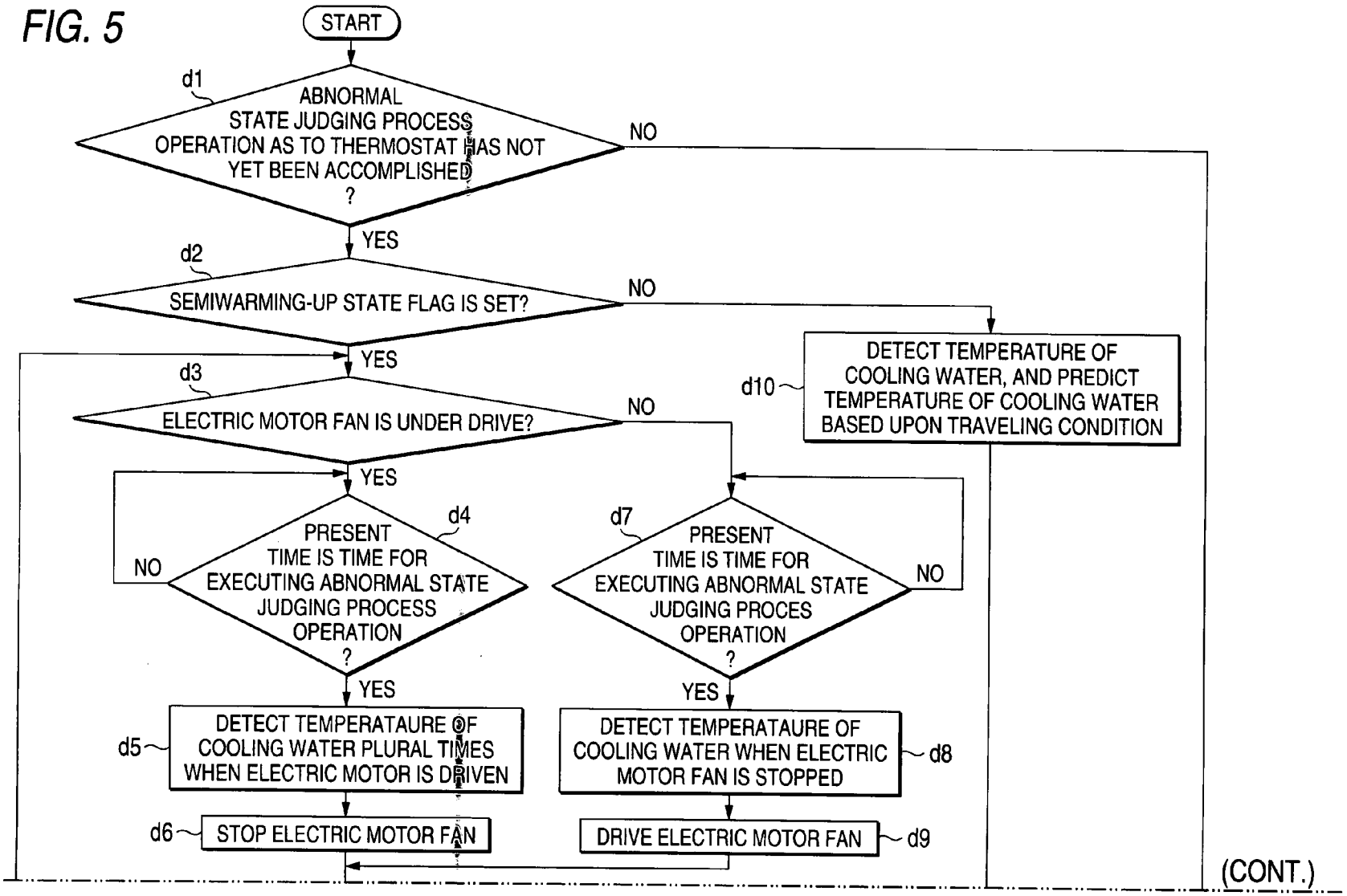
FIG. 5 is a flow chart for describing an example of another abnormal state detecting process operation as to the thermostat 13.

As previously explained, the preprocessing operation for judging as to whether or not the engine 17 is under the semiwarming-up state is carried out only one time when the engine 17 is started. Thereafter, any one of the below-mentioned abnormal state detecting process operations as to the thermostat 13, shown in FIG. 3, FIG. 4, and FIG. 5, is executed as an interrupt process operation every time a predetermined time period has elapsed.

Figure 3:
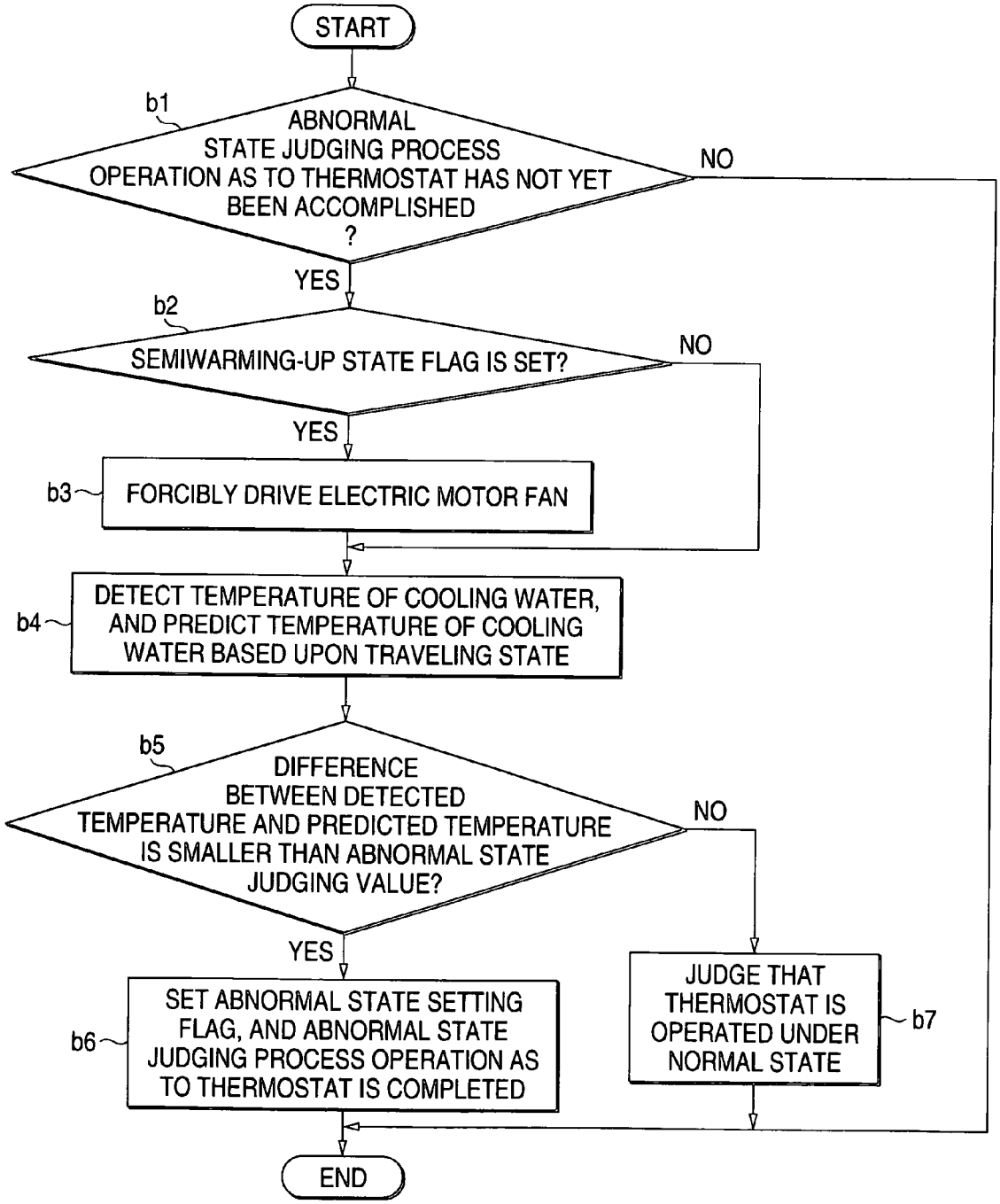
FIG. 3 is a flow chart for describing an example of an abnormal state detecting process operation as to the thermostat 13.

FIG. 3 is a flow chart for describing an example of the abnormal state detecting process operation as to the thermostat 13. In a step b1, the CPU 21 judges as to whether or not the abnormal state judging process operation as to the thermostat 13 has not yet been accomplished. When the CPU 21 so judges that the abnormal state judging process operation as to the thermostat 13 has not yet been accomplished in the step b1, the abnormal state detecting process operation is advanced to a step b2. When the CPU 21 so judges that the abnormal state judging process operation as to the thermostat 13 has been accomplished in the step b1, the abnormal state judging process operation as to the thermostat 13 is ended.

In the step b2, the CPU 21 checks as to whether or not "1" is set as the semiwarming-up state flag in this embodiment. When the CPU 21 so judges that the semiwarming-up state flag "1" is set in the step b2, the abnormal state detecting process operation is advanced to a step b3. When the CPU 21 so judges that the semiwarming-up state flag "1" is not set, namely the state flag "0" other than the semiwarming-up state is set in the step b2, the process operation is advanced to a step b4.

In the step b3, the electric motor fan 12 is forcibly driven. In the step b4, a cooling water temperature is detected by the water temperature sensor 3, and further, the program for predicting the cooling water temperature is executed by the CPU 21 based upon the drive condition of the engine 17 so as to predict a temperature of the cooling water. It should also be understood that in this step b4, since both the program for calculating the temperature gradient of the detected temperatures based upon the temporal change of the detected temperatures, and also, the program for calculating the temperature gradient of the predicted temperatures based upon the temporal change of the predicted temperatures are executed by the CPU 21, both a temperature gradient of the detected temperatures and a temperature gradient of the predicted temperatures may be alternatively calculated.

In a step b5, in such a case that the cooling water temperature is detected and the cooling water temperature is predicted based upon the operation condition of the engine 17 in the step b4, since the program for calculating the difference between the detected temperature and the predicted temperature is executed by the CPU 21, a difference between the detected temperature and the predicted temperature is calculated. Then, the calculated temperature difference is compared with a predetermined abnormal state judging value in order to judge as to whether or not the above-calculated temperature difference is smaller than the abnormal state judging value.

Also, in the step b5, in the case that both the temperature gradient of the detected temperature and the temperature gradient of the predicted temperature are calculated in the step b4, since the program for calculating the difference between the temperature gradient of the detected temperatures and the temperature gradient of the predicted temperatures is executed by the CPU 21, a difference between the calculated temperature gradient of the detected temperatures and the calculated temperature gradient of the predicted temperatures is calculated. Then, the calculated temperature gradient difference is compared with a predetermined abnormal state judging value in order to judge as to whether or not the above-calculated temperature gradient difference is smaller than the abnormal state judging value.

In the step b5, when the CPU so judges that either the temperature difference or the temperature gradient difference is smaller than the predetermined abnormal state judging value, the process operation is advanced to a step b6. In the step b5, when the CPU so judges that either the temperature difference or the temperature gradient difference is larger than, or equal to the predetermined abnormal state judging value, the process operation is advanced to a step b7.

In the step b6, the abnormal state judging unit 22 judges that the thermostat 13 is brought into an abnormal valve opening state, and sets an abnormal state judging flag, for example, "1" in this embodiment, and also stores this flag "1" into the RAM 24 so as to complete the abnormal state judging process operation as to the thermostat 13. Thus, the abnormal state detecting process operation as to the thermostat 13 is ended. In this case, the above-described abnormal state judging flag corresponds to such a flag for judging as to whether or not a control operation for notifying such a fact that the abnormal state happens to occur in the thermostat 13 to the user is carried out by turning ON an abnormal state lamp on an indicator.

In the above-described step b5, either the difference between the detected temperature and the predicted temperature or the difference between the temperature gradient of the detected temperatures and the temperature gradient of the predicted temperatures is compared with the predetermined abnormal state judging value so as to judge the abnormal state of the thermostat 13. However, the present invention is not limited only to the above-described process operation, but may be realized by executing the below-mentioned process operation. That is to say, either a ratio of the detected temperature with respect to the predicted temperature or a ratio of the temperature gradient of the detected temperatures with respect to the temperature gradient of the predicted temperatures may be alternatively compared with the predetermined abnormal state judging value in order to perform the abnormal state judging operation as to the thermostat 13.

As previously explained, when the abnormal state judging unit 22 judges that the semiwarming-up state flag "1" has been set, the abnormal state judging unit 22 drives the electric motor fan 12 so as to forcibly cool the cooling water contained in the radiator 11. When the electric motor fan 12 is driven, if the thermostat 13 is under the abnormal valve opening state, then the valve of this thermostat 13 is brought into the open state, and thus, the cooling water cooled by driving the electric motor fan 12 is circulated with the cooling water circulating path 15. As a result, the increasing degree of the detected temperatures becomes gently, as compared with such a condition that the thermostat 13 is operated under normal condition and the valve of this thermostat 13 is under close state. As a consequence, for example, if the difference between the detected temperature and the predicted temperature is calculated after the electric motor fan 12 has been driven, then the temperature difference thereof becomes large, as compared with that of such a case that the electric motor fan 12 is not driven. Thus, a difference between the temperature increasing degrees obtained when the thermostat 13 is operated under normal state and also under abnormal state may become clear.

As a consequence, the abnormal state judging unit 22 only judges that the engine 17 is under the semiwarming-up state, and merely judges as to whether or not the difference between the detected temperature and the predicted temperature is smaller than the predetermined abnormal state judging value, so that this abnormal judging unit 22 can judge as to whether or not the thermostat 13 is under the abnormal valve opening state. Accordingly, the abnormal state judging unit 22 may readily detect the abnormal state of the thermostat 13 even under the semiwarming-up state.

FIG. 4 is a flow chart for explaining an example of the abnormal state detecting process operation as to the thermostat 13. In a step c1, the CPU 21 judges as to whether or not the abnormal state processing operation as to the thermostat 13 has not yet been accomplished. When the CPU 21 judges in this step c1 that the abnormal state judging process operation of the thermostat 13 has not yet been accomplished, the abnormal state detecting process operation is advanced to a step c2. To the contrary, when the CPU 21 judges in the step c1 that the abnormal judging process operation as to the thermostat 13 has been accomplished, the abnormal state detecting process operation as to the thermostat 13 is ended.

In the step c2, the CPU 21 judges as to whether or not the semiwarming-up state flag, namely the flag "1" in this embodiment is set. In the step c2, when the CPU 21 judges that the semiwarming-up state flag "1" is set, the process operation is advanced to a step c3. In step c2, when the CPU 21 judges that the semiwarming-up state flag "1" is not set, the process operation is advanced to a step c7. In other words, when the CPU 21 judges that the state flag "0" other than the semiwarming-up state is set, the process operation is advanced to the step c7.

In the step c3, the CPU 21 judges as to whether or not the vehicle is stopped. When the CPU 21 judged in the step c3 that the vehicle is stopped, the process operation is advanced to a step c4. When the CPU 21 judged in the step c3 that the vehicle is not stopped, the process operation is advanced to a step c5.

In the step c4, a drive duty used when the electric motor fan 12 is driven is set to 50%. In the step c5, a drive duty of the electric motor fan 12 corresponding to the present vehicle speed of the vehicle is calculated with reference to the duty map stored in the ROM 23. In a step c6, the electric motor fan 12 is driven based upon either the dive duty set in the step c4 or the drive duty calculated in the step c5.

In the step c7, a cooling water temperature is detected by the water temperature sensor 3, and further, the program for predicting the cooling water temperature is executed by the CPU 21 based upon the drive condition of the engine 17 so as to predict a temperature of the cooling water. It should also be understood that in this step c7, since both the program for calculating the temperature gradient of the detected temperatures based upon the temporal change of the detected temperatures, and also, the program for calculating the temperature gradient of the predicted temperatures based upon the temporal change of the predicted temperatures are executed by the CPU 21, both a temperature gradient of the detected temperatures and a temperature gradient of the predicted temperatures may be alternatively calculated.

In a step c8, in such a case that the cooling water temperature is detected and the cooling water temperature is predicted based upon the operation condition of the engine 17 in the step c7, since the program for calculating the difference between the detected temperature and the predicted temperature is executed by the CPU 21, a difference between the detected temperature and the predicted temperature is calculated. Then, the calculated temperature difference is compared with a predetermined abnormal state judging value in order to judge as to whether or not the above-calculated temperature difference is smaller than the abnormal state judging value.

Also, in the step c8, in the case that both the temperature gradient of the detected temperature and the temperature gradient of the predicted temperature are calculated in the step c7, since the program for calculating the difference between the temperature gradient of the detected temperature and the temperature gradient of the predicted temperature is executed by the CPU 21, a difference between the calculated temperature gradient of the detected temperature and the calculated temperature gradient of the predicted temperature is calculated. Then, the calculated temperature gradient difference is compared with a predetermined abnormal state judging value in order to judge as to whether or not the above-calculated temperature gradient difference is smaller than the abnormal state judging value.

In the step c8, when the CPU 21 so judges that either the temperature difference or the temperature gradient difference is smaller than the predetermined abnormal state judging value, the process operation is advanced to a step c9. In the step c8, when the CPU 21 so judges that either the temperature difference or the temperature gradient difference is larger than, or equal to the predetermined abnormal state judging value, the process operation is advanced to a step c10.

In the step c9, the abnormal state judging unit 22 judges that the thermostat 13 is brought into an abnormal valve opening state, and sets an abnormal state judging flag, for example, "1" in this embodiment, and also stores this flag "1" into the RAM 24 so as to complete the abnormal state judging process operation as to the thermostat 13. Thus, the abnormal state detecting process operation as to the thermostat 13 is ended. In this case, the above-described abnormal state judging flag corresponds to such a flag for judging as to whether or not a control operation for notifying such a fact that the abnormal state happens to occur in the thermostat 13 to the user is carried out by turning ON an abnormal state lamp on an indicator. At a step c10, the abnormal state judging unit 22 judges that the thermostat 13 is operated under normal condition, and then accomplishes the abnormal state detecting process operation of the thermostat 13.

In the above-described step c8, either the difference between the detected temperature and the predicted temperature or the difference between the temperature gradient of the detected temperatures and the temperature gradient of the predicted temperatures is compared with the predetermined abnormal state judging value so as to judge the abnormal state of the thermostat 13. However, the present invention is not limited only to the above-described process operation, but may be realized by executing the below-mentioned process operation. That is to say, either a ratio of the detected temperature with respect to the predicted temperature or a ratio of the temperature gradient of the detected temperatures with respect to the temperature gradient of the predicted temperatures may be alternatively compared with the predetermined abnormal state judging value in order to perform the abnormal state judging operation as to the thermostat 13.

As previously explained, when the abnormal state judging unit 22 judges that the semiwarming-up state flag "1" has been set, the abnormal state judging unit 22 drives the electric motor fan 12, while changing the rotation speed of the electric motor fan 12 in response to a drive condition of the engine 17, for instance, a travel speed of the vehicle. Concretely speaking, when the vehicle is traveled in a high speed, since a wind amount is large which is received along the traveling direction of the vehicle, the rotation speed of the electric motor fan 12 is decreased to drive this electric motor fan 12 at this decreased rotation speed. Also, when the vehicle is traveled in a low speed, since a wind amount is small which is received along the traveling direction of the vehicle, the rotation speed of the electric motor fan 12 is increased to drive this electric motor fan 12 at this increased rotation speed. Also, when the vehicle is stopped, since there is no wind amount produced by traveling the vehicle, the rotation speed of the electric motor fan 12 is increased. Further, since a battery is not recharged by traveling the vehicle, the drive duty is set to 50% and then the electric motor fan 12 is driven. As previously explained, the electric motor fan 12 is driven in such a manner that the rotation speed of the electric motor fan 12 is changed in response to the traveling speed of the vehicle, so that the electric load given to the electric motor fan 12, for example, the load given to the battery can be reduced.

Also, while the rotation speed of the electric motor fan 12 is changed in response to the traveling speed of the vehicle, the abnormal state judging unit 22 forcibly drives the electric motor fan 12 so as to forcibly cool the cooling water contained in the radiator 11. When the electric motor fan 12 is forcibly driven, if the thermostat 13 is under the abnormal valve opening state, then the valve of this thermostat 13 is brought into the open state, and thus, the cooling water forcibly cooled by driving the electric motor fan 12 is circulated in the cooling water circulating path 15. As a result, the increasing degree of the detected temperatures becomes gently, as compared with such a condition that the thermostat 13 is operated under normal condition and the valve of this thermostat 13 is under close state. As a consequence, for example, if the difference between the detected temperature and the predicted temperature is calculated after the electric motor fan 12 has been forcibly driven, then the temperature difference thereof becomes large, as compared with that of such a case that the electric motor fan 12 is not driven. Thus, a difference between the temperature increasing degrees obtained when the thermostat 13 is operated under normal state and also under abnormal state may become clear.

As a consequence, the abnormal state judging unit 22 only judges that the engine 17 is under the semiwarming-up state, and merely judges as to whether or not the difference between the detected temperature and the predicted temperature is smaller than the predetermined judging value, so that this abnormal judging unit 22 can judge as to whether or not the thermostat 13 is under the abnormal valve opening state. Accordingly, the abnormal state judging unit 22 may readily detect the abnormal state of the thermostat 13 even under the semiwarming-up state.

FIG. 5 is a flow chart for explaining an example of the abnormal state detecting process operation as to the thermostat 13. In a step d1, the CPU 21 judges as to whether or not the abnormal state processing operation as to the thermostat 13 has not yet been accomplished. When the CPU 21 judges in this step d1 that the abnormal state judging process operation of the thermostat 13 has not yet been accomplished, the abnormal state detecting process operation is advanced to a step d2. To the contrary, when the CPU 21 judges in the step d1 that the abnormal judging process operation as to the thermostat 13 has been accomplished, the abnormal state detecting process operation as to the thermostat 13 is ended.

In the step d2, the CPU 21 judges as to whether or not the semiwarming-up state flag, namely the flag "1" in this embodiment is set. In the step d2, when the CPU 21 judges that the semiwarming-up state flag "1" is set, the process operation is advanced to a step d3. When, in the step d2 the CPU 21 judges that the semiwarming-up state flag "1" is not set, the process operation is advanced to a step d10. In other words, when the CPU 21 judges that the state flag "0" other than the semiwarming-up state is set, the process operation is advanced to the step d10.

In the step d3, the CPU 21 judges as to whether or not the electric motor fan 12 is under drive operation. In the step d3, when the CPU 21 judges that the electric motor fan 12 is under drive operation, the process operation is advanced to a step d4. In the step d3, when the CPU 21 judges that the electric motor fan 12 is not under drive operation, the process operation is advanced to a step d7.

In the step d4, the CPU 21 judges as to whether or not the present time corresponds to such a time that the abnormal state judging process operation is executed. In the step d4, when the CPU 21 judges that the present time corresponds to such a time that the abnormal state judging process operation is carried out, the process operation is advanced to a step d5. In the step d4, when the CPU 21 judges that the present time does not correspond to such a time that the abnormal state judging process operation is carried out, the CPU 21 waits until the time for executing the abnormal state judging process operation becomes. It should also be noted that the time for executing the abnormal state judging process operation is previously determined.

In a step d5, a temperature of the cooling water when the electric motor 12 is driven is repeatedly detected plural times. In a step d6, the electric motor fan 12 is stopped. After the electric motor fan 12 has been stopped in the step d6, the process operation is advanced to a step d11. It should also be noted that the temperature of the cooling water when the electric motor 12 is driven may be alternatively detected only one time in the step d5. Alternatively, since the program for calculating the temperature gradient of the detected temperatures based upon the temporal change of the detected temperatures may be carried out by the CPU 21 in the step d5, a temperature gradient of the detected temperatures when the electric motor fan 12 is driven maybe calculated plural times, or only one time.

In the step d7, the CPU 21 judges as to whether or not the present time corresponds to such a time that the abnormal state judging process operation is executed. In the step d7, when the CPU 21 judges that the present time corresponds to such a time that the abnormal state judging process operation is carried out, the process operation is advanced to a step d8. In the step d7, when the CPU 21 judges that the present time does not correspond to such a time that the abnormal state judging process operation is carried out, the CPU 21 waits until the time for executing the abnormal state judging process operation becomes. It should also be noted that the time for executing the abnormal state judging process operation is previously determined.

In the step d8, a temperature of the cooling water when the electric motor 12 is stopped is repeatedly detected plural times. In a step d9, the electric motor fan 12 is driven. After the electric motor fan 12 has been stopped in the step d9, the process operation is advanced to the step d11. It should also be noted that the temperature of the cooling water when the electric motor 12 is stopped may be alternatively detected only one time in the step d8. Alternatively, since the program for calculating the temperature gradient of the detected temperatures based upon the temporal change of the detected temperatures may be carried out by the CPU 21 in the step d8, a temperature gradient of the detected temperatures when the electric motor fan 12 is stopped maybe calculated plural times, or only one time.

In a step d10, a cooling water temperature is detected by the water temperature sensor 3, and further, the program for predicting the cooling water temperature is executed by the CPU 21 based upon the drive condition of the engine 17 so as to predict a temperature of the cooling water. It should also be understood that in this step d10, since both the program for calculating the temperature gradient of the detected temperatures based upon the temporal change of the detected temperatures, and also, the program for calculating the temperature gradient of the predicted temperatures based upon the temporal change of the predicted temperatures are executed by the CPU 21, both a temperature gradient of the detected temperatures and a temperature gradient of the predicted temperatures may be alternatively calculated. As previously explained, after both the detecting operation of the cooling water temperature and the predicting operation of the cooling water temperature have been carried out, or the calculating operations as to both the temperature gradient of the detected temperatures and the temperature gradient of the predicted temperatures have been carried out in the step d10, the process operation is advanced to a step d13.

In the step d11, the CPU 21 judges as to whether or not the cooling water temperatures when the electric motor fan 12 is driven and stopped have been repeatedly detected plural times in the step d5, or whether or not the temperature gradients of the detected temperatures when the electric motor fan 12 is driven and stopped have been repeatedly calculated plural times in the step d8. When the CPU 21 judges in the step d11 that the cooling water temperatures when the electric motor fan 12 is driven and stopped have been repeatedly detected plural times, or when the CPU 21 judges that the temperature gradients of the detected temperatures when the electric motor fan 12 is driven and stopped have been repeatedly calculated plural times, the process operation is advanced to a step d12. In step d11, the CPU 21 judges that the cooling water temperatures when the electric motor fan 12 is driven and stopped have not been repeatedly detected plural times, or the CPU 21 judges that the temperature gradients of the detected temperatures when the electric motor fan 12 is driven and stopped have not been repeatedly calculated plural times, the process operation is returned to the step d3.

In the step d12, in such a case that the cooling water temperatures have been repeatedly detected plural times in both the step d5 and the step d8, the CPU 21 calculates an averaged value of differences between the cooling water temperatures which have been repeatedly detected plural times when the electric motor fan 12 is driven in the step d5, and the cooling water temperatures which have been repeatedly detected plural times when the electric motor fan 12 is stopped in the step d8, and then, stores this calculated averaged value into the RAM 24.

In the step d12, in such a case that the temperature gradients of the detected temperatures have been repeatedly detected plural times in both the step d5 and the step d8, the CPU 21 calculates an averaged value of differences between the temperature gradients of the detected temperatures which have been repeatedly detected plural times when the electric motor fan 12 is driven in the step d5, and the temperature gradients of the detected temperatures which have been repeatedly detected plural times when the electric motor fan 12 is stopped in the step d8, and then, stores this calculated averaged value into the RAM 24.

In a step d13, the CPU 21 reads out from the RAM 24, either the averaged value of the differences between the detected temperatures or the averaged value of the differences between the temperature gradients of the detected temperatures, which have been calculated and also stored in the RAM 24 in the step d12. Then, the CPU 21 compares either the averaged value of the differences between the detected temperatures or the averaged value of the differences between the temperature gradients of the detected temperatures with a predetermined abnormal state judging value, and judges as to whether or not either the averaged value of the differences between the detected temperatures or the averaged value of the differences between the temperature gradients of the detected temperatures is larger than, or equal to the predetermined abnormal state judging value.

Also, in the step d13, in such a case that either both the detection of the cooling water temperature and the prediction of the cooling water temperature or both the calculation of the temperature gradation of the detected temperatures and the calculation of the temperature gradient of the predicted temperatures have been carried out in the step d10, the CPU 21 compares either the difference between the detected temperature and the predicted temperature or the difference between the temperature gradient of the detected temperature and the temperatures gradient of the predicted temperature with a predetermined abnormal state judging value, and thus, judges as to whether or not either the difference between the detected temperature and the predicted temperature or the difference between the temperature gradient of the detected temperature and the temperatures gradient of the predicted temperature is smaller than the predetermined abnormal state judging value.

In the step d13, in the case that the cooling water temperatures have been repeatedly detected plural times in both the step d5 and the step d8, the CPU 21 may alternatively calculate a difference between any one of the plural cooling water temperatures detected when the electric motor fan 12 is driven, and any one of the plural cooling water temperatures detected when the electric motor fan 12 is stopped, and then the CPU 21 may alternatively compare the calculated difference between one cooling water temperature with a predetermined abnormal state judging value in order to judge as to whether or not the above-described difference between the cooling water temperatures is larger than, or equal to the predetermined abnormal state judging value.

In the step d13, in the case that the temperature gradients of the detected temperatures have been repeatedly detected plural times in both the step d5 and the step d8, the CPU 21 may alternatively calculate a difference between any one of the plural temperature gradients of the detected temperatures detected when the electric motor fan 12 is driven, and any one of the plural temperature gradients of the detected temperatures detected when the electric motor fan 12 is stopped, and then the CPU 21 may alternatively compare the calculated difference between one temperature gradient with a predetermined abnormal state judging value in order to judge as to whether or not the above-described difference between the temperature gradients is larger than, or equal to the predetermined abnormal state judging value.

When the CPU 21 judges in the step d13 that any one of the averaged value of the differences between the cooling water temperatures and the averaged value of the differences between the temperature gradients based upon the step d12, and also both the difference between the cooling water temperatures and the difference between the temperature gradients based upon the step d5 and the step d8 is larger than, or equal to the predetermined abnormal state judging value, and further, the CPU 21 judges in this step d13 that either the difference between the detected temperature and the predicted temperature or the difference between the temperature gradient of the detected temperatures and the temperature gradient of the predicted temperatures based upon the step d10 is smaller than the predetermined abnormal state judging value, the process operation is advanced to a step d14.

When the CPU 21 judges in the step d13 that any one of the averaged value of the differences between the cooling water temperatures and the averaged value of the differences between the temperature gradients based upon the step d12, and also both the difference between the cooling water temperatures and the difference between the temperature gradients based upon the step d5 and the step d8 is smaller than the predetermined abnormal state judging value, and further, the CPU 21 judges in this step d13 that either the difference between the detected temperature and the predicted temperature or the difference between the temperature gradient of the detected temperatures and the temperature gradient of the predicted temperatures based upon the step d10 is larger than, or equal to the predetermined abnormal state judging value, the process operation is advanced to a step d15.

In the step d14, the abnormal state judging unit 22 judges that the thermostat 13 is brought into an abnormal valve opening state, and sets an abnormal state judging flag, for example, "1" in this embodiment, and also stores this flag "1" into the RAM 24 so as to complete the abnormal state judging process operation as to the thermostat 13. Thus, the abnormal state detecting process operation as to the thermostat 13 is ended. In this case, the above-described abnormal state judging flag corresponds to such a flag for judging as to whether or not a control operation for notifying such a fact that the abnormal state happens to occur in the thermostat 13 to the user is carried out by turning ON an abnormal state lamp on an indicator. At the step d15, the abnormal state judging unit 22 judges that the thermostat 13 is operated under normal condition, and then accomplishes the abnormal state detecting process operation of the thermostat 13.

In the above-described step d5, in such a case that the cooling water temperatures are repeatedly detected plural times, for instance, the rotation speed of the electric motor fan 12, namely the drive duty may be varied in response to the travel speed of the vehicle every time a predetermined time has elapsed.

In the above-described step d12, the CPU 21 calculates the averaged value of the differences between the cooling water temperatures repeatedly detected plural times in the step d5 when the electric motor fan 12 is driven and the cooling water temperatures repeatedly detected plural times in the step d8 when the electric motor fan 12 is stopped. Otherwise, in the step d12, the CPU 21 calculates the averaged value of the differences between the temperature gradients of the detected temperatures which have been repeatedly calculated plural times in the step d5 when the electric motor fan 12 is driven and the temperature gradients of the detected temperatures which have been repeatedly calculated plural times in the step d8 when the electric motor fan 12 is stopped. Then, the CPU 21 stores these calculated average values into the RAM 24. However, the present invention is not limited only to the above-described process operation, but may be realized by executing the below-mentioned process operation.

In other words, in the step d12, the CPU 21 may alternatively calculate either an averaged value of the cooling water temperatures or an averaged value of the temperature gradients, which have been repeatedly detected plural times when the electric motor fan 12 is driven in the step d5, and then may store the calculated averaged values into the RAM 24. Alternatively, in the step d12, the CPU 21 may alternatively calculate either an averaged value of the cooling water temperatures or an averaged value of the temperature gradients, which have been repeatedly detected plural times when the electric motor fan 12 is stopped in the step d8, and then may store the calculated averaged values into the RAM 24.

In the step d12, when either the averaged value of the cooling water temperatures which have been repeatedly detected plural times or the averaged value of the temperature gradients which have been repeatedly calculated plural times is calculated, an upper limit value of a cooling water temperature to be detected maybe alternatively set to, for example, 70 degrees, and also, a lower limit value thereof may be alternatively set to, for instance, 50 degrees. Then, only such detected temperatures defined within a range between the upper limit value and the lower limit value may be employed. As a result, the precision of detecting the abnormal state of the thermostat 13 may be improved.

It should also be noted that in the above-described step d13, the CPU 21 may alternatively compare the predetermined abnormal state judging value with a ratio of the cooling water temperatures repeatedly detected plural times when the electric motor fan 12 is driven with respect to the cooling water temperatures repeatedly detected plural times when the electric motor fan 12 is stopped, or another ratio of the temperature gradients of the detected temperatures repeatedly calculated plural times when the electric motor fan 12 is driven with respect to the temperature gradients of the detected temperatures repeatedly calculated plural times when the electric motor fan 12 is stopped in order to perform the abnormal state judging operation as to the thermostat 13.

As previously explained, when the abnormal state judging unit 22 judges that the semiwarming-up state flag "1" has been set, the abnormal state judging unit 22 drives the electric motor fan 12 in an intermittent manner. Concretely speaking, after the electric motor fan 12 has been driven only for a preselected time period, the electric motor fan 12 is caused to be stopped only during a predetermined time period. As previously described, after the abnormal state judging unit 22 has been driven in the intermittent manner, this abnormal state judging unit 22 judges as to whether or not the thermostat 13 is under an abnormal valve opening state. The judgement as to whether or not the thermostat 13 is under the abnormal valve opening state is carried out as follows: For instance, the CPU 21 calculates an averaged value of differences between the cooling water temperatures repeatedly detected plural times when the electric motor fan 12 is driven and the cooling water temperatures repeatedly detected plural times when the electric motor fan 12 is stopped, and then, when the calculated average value is larger than, or equal to the predetermined abnormal state judging value, the abnormal state judging unit 2 judges that the thermostat 13 is under the abnormal valve opening state.

As previously explained, when the electric motor 12 is driven in the intermittent manner, if the thermostat 13 is operated under normal condition, then there is no large change in the increasing degrees of the detected temperatures irrespective of driving operation, or stopping operation of the electric motor fan 12. However, when the thermostat 13 is under the abnormal valve opening state, an increasing degree of a detected temperature when the electric motor fan 12 is driven is largely different from an increasing degree of a detected temperature when the electric motor fan 12 is stopped. As a consequence, when the electric motor fan 12 is driven in the intermittent manner, the abnormal state of the thermostat 13 can be detected in relatively high precision, as compared with such a case that the electric motor 12 is merely driven for a predetermined time period.

Also, every time a predetermined time period has elapsed, the abnormal state judging unit 22 calculates a difference between the cooling water temperatures repeatedly detected plural times when the electric motor fan 12 is driven and the cooling water temperatures repeatedly detected plural times when the electric motor fan 12 is stopped, and then calculates an averaged value of differences between the calculated cooling water temperatures so as to compare the averaged value of the differences of the cooling water temperatures with the predetermined abnormal state judging value. As a consequence, the abnormal state of the thermostat 13 can be detected in relatively high precision, as compared with such a case that the abnormal state judging unit 22 calculates a difference between anyone of the plural cooling water temperatures detected when the electric motor fan 12 is driven, and any one of the plural cooling water temperatures detected when the electric motor fan 12 is stopped, and then the abnormal state judging unit 22 compares the calculated difference between one cooling water temperature with a predetermined abnormal state judging value. Furthermore, when the abnormal state judging unit 22 judges that the semiwarming-up state flag "1" has been set, the abnormal state judging unit 22 drives the electric motor fan 12 in the intermittent manner. Accordingly, the abnormal state judging unit 22 may readily detect the abnormal state of the thermostat 13 even under the semiwarming-up state.

Next, a description is made of another abnormal state detecting process operation as to the thermostat 13. In the flow chart for explaining the abnormal state detecting process operation as to the thermostat 13, indicated in FIG. 3, FIG. 4 and FIG. 5, as a preprocessing operation to be executed before the processing operation for judging as to whether or not the abnormal state judging process operation as to the thermostat 13 has not yet been accomplished, namely the preprocessing operations defined in the step b1, the step c1, and the step d1, a judgment is made as to whether or not a predetermined time period has elapsed. In this embodiment, as this predetermined time period, for example, such a time is set which requires that cooling water is circulated through the cooling water circulating path 15 one time. Alternatively, this predetermined time period may be selected from any time other than the above-set time in this embodiment.

When the engine 17 is started, there is a difference between a temperature of the cooling water contained in the cooling water circulating path 15 provided on the side of the engine 17 and a temperature of the cooling water contained in the cooling water circulating path 15 provided on the side of the radiator 11. As a consequence, as previously explained, since the execution of the abnormal state judging process operation as to the thermostat 13 is brought into a waiting state until the predetermined time period has elapsed, both the cooling water contained in the cooling water circulating path 15 provided on the side of the engine 17 and the cooling water contained in the cooling water circulating path 15 provided on the side of the radiator 11 are circulated. As a result, both the temperature of the cooling water contained in the cooling water circulating path 15 provided on the side of the engine 17 and the temperature of the cooling water contained in the cooling water circulating path 15 provided on the side of the radiator 11 can be made constant. Accordingly, the abnormal state of the thermostat 13 can be detected in relatively high precision, as compared with such a case that the abnormal state detecting operation of the thermostat 13 is carried out under such a condition that there is a difference between the temperature of the cooling water contained in the cooling water circulating path 15 provided on the side of the engine 17 and the temperature of the cooling water contained in the cooling water circulating path 15 provided on the side of the radiator 11, while the predetermined time period has not elapsed.

As previously described, in this embodiment, the abnormal state detecting process operation as to the thermostat 13, shown in FIG. 2, is arranged in such a form that after the preprocessing operation involved in this abnormal state detecting process operation has been carried out only one time when the engine 17 is started, any one of the abnormal state detecting process operations as to the thermostat 13, shown in FIG. 3, FIG. 4, and FIG. 5, is carried out as the interrupt processing operation every time the predetermined time has elapsed. Alternatively, the abnormal state detecting process operation as to the thermostat 13 may be arranged in such a form that after such an abnormal state detecting process operation (will be explained later) as represented in FIG. 6 has been carried out only one time when the engine 17 is started, any one of the abnormal state detecting process operations as to the thermostat 13, shown in FIG. 3, FIG. 4, and FIG. 5, is carried out as the interrupt processing operation every time the predetermined time has elapsed.

Figure 6:
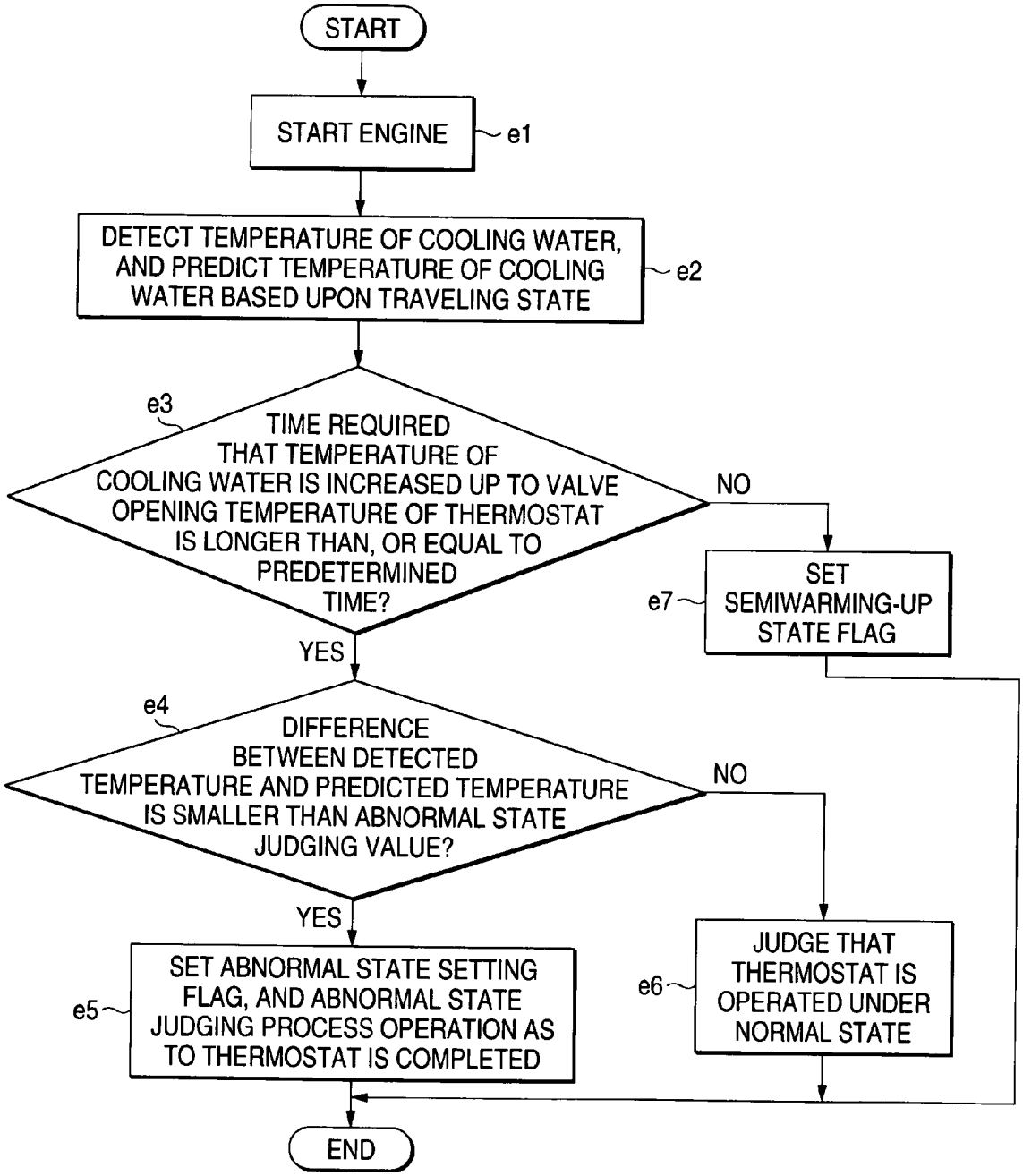
FIG. 6 is a flow chart for explaining an example of another abnormal state detecting process operation as to the thermostat 13.
Figure 7:
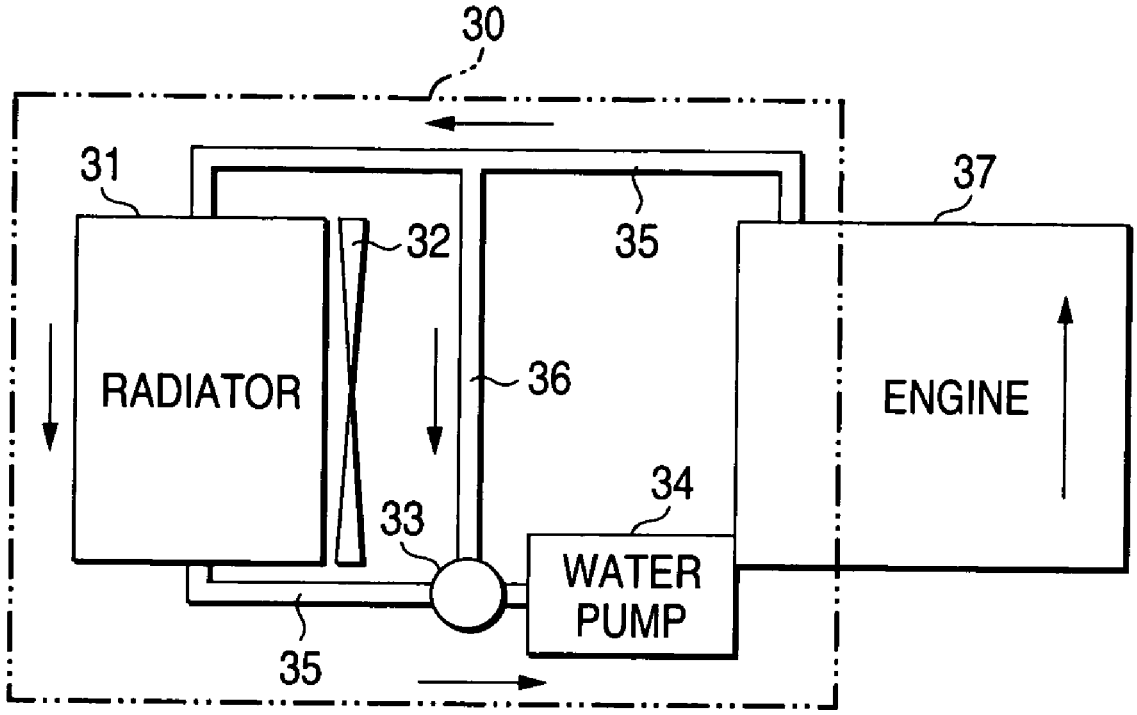
FIG. 7 is a diagram for indicating the simplified arrangement of the conventional cooling apparatus 30.

FIG. 6 is a flow chart for describing an example of an abnormal state detecting process operation as to the thermostat 13. In a step e1, the power switch of the engine 17 is turned ON so as to start the engine 17. In a step e2, a cooling water temperature is detected by the water temperature sensor 3, and further, the program for predicting the cooling water temperature is executed by the CPU 21 based upon the drive condition of the engine 17 so as to predict a temperature of the cooling water. It should also be understood that in this step e2, since both the program for calculating the temperature gradient of the detected temperatures based upon the temporal change of the detected temperatures, and also, the program for calculating the temperature gradient of the predicted temperatures based upon the temporal change of the predicted temperatures are executed by the CPU 21, both a temperature gradient of the detected temperatures and a temperature gradient of the predicted temperatures may be alternatively calculated. As previously described, in the step e2, after both the detecting operation of the cooling water temperature and the predicting operation of the cooling water temperature, or both the calculating operation of the temperature gradient of the detected temperatures and the calculating operation of the temperature gradient of the predicting operations have been carried out, the process operation is advanced to a step e3.

In the step e3, the CPU 21 judges as to whether or not time defined by that the temperature of the cooling time detected in the step e2 is increased up to a valve opening temperature of the thermostat 13 is longer than, or equal to a predetermined time. The first-mentioned time will be simply referred to as an "increasing time" hereinafter, if necessary. When the CPU 21 judges that the above-explained increasing time is longer than, or equal to the predetermined time in the step e3, the process operation is advanced to a step e4. When the CPU 21 judges that the above-explained increasing time is shorter than the predetermined time in the step e3, the process operation is advanced to a step e7.

In a step e4, in such a case that the cooling water temperature is detected and the cooling water temperature is predicted based upon the operation condition of the engine 17 in the step e2, since the program for calculating the difference between the detected temperature and the predicted temperature is executed by the CPU 21, a difference between the detected temperature and the predicted temperature is calculated. Then, the calculated temperature difference is compared with a predetermined abnormal state judging value in order to judge as to whether or not the above-calculated temperature difference is smaller than the abnormal state judging value.

Also, in the step e4, in the case that both the temperature gradient of the detected temperature and the temperature gradient of the predicted temperature are calculated in the step e2, since the program for calculating the difference between the temperature gradient of the detected temperatures and the temperature gradient of the predicted temperatures is executed by the CPU 21, a difference between the calculated temperature gradient of the detected temperatures and the calculated temperature gradient of the predicted temperatures is calculated. Then, the calculated temperature gradient difference is compared with a predetermined abnormal state judging value in order to judge as to whether or not the above-calculated temperature gradient difference is smaller than the abnormal state judging value.

In the step e4, when the CPU so judges that either the temperature difference or the temperature gradient difference is smaller than the predetermined abnormal state judging value, the process operation is advanced to a step e5. In the step e4, when the CPU so judges that either the temperature difference or the temperature gradient difference is larger than, or equal to the predetermined abnormal state judging value, the process operation is advanced to a step e6.

In a step e7, a semiwarming-up state flag, for example, a flag "1" in this embodiment, is set, and is stored into the RAM 24. Thereafter, the abnormal state detecting process operation is accomplished.

In the step e5, the abnormal state judging unit 22 judges that the thermostat 13 is brought into an abnormal valve opening state, and sets an abnormal state judging flag, for example, "1" in this embodiment, and also stores this flag "1" into the RAM 24 so as to complete the abnormal state judging process operation as to the thermostat 13. Thus, the abnormal state detecting process operation as to the thermostat 13 is ended. In this case, the above-described abnormal state judging flag corresponds to such a flag for judging as to whether or not a control operation for notifying such a fact that the abnormal state happens to occur in the thermostat 13 to the user is carried out by turning ON an abnormal state lamp on an indicator. In the step e6, the abnormal state judging unit 22 judges that the thermostat 13 is operated under normal state, and thus, the abnormal state detecting process operation as to the thermostat 13 is accomplished.

In the above-described step e4, either the difference between the detected temperature and the predicted temperature or the difference between the temperature gradient of the detected temperatures and the temperature gradient of the predicted temperatures is compared with the predetermined abnormal state judging value so as to judge the abnormal state of the thermostat 13. However, the present invention is not limited only to the above-described process operation, but may be realized by executing the below-mentioned process operation. That is to say, either a ratio of the detected temperature with respect to the predicted temperature or a ratio of the temperature gradient of the detected temperatures with respect to the temperature gradient of the predicted temperatures may be alternatively compared with the predetermined abnormal state judging value, and then, the CPU 21 may alternatively judge as to whether or not either the ratio of the detected temperature with respect to the predicted temperature or the ratio of the temperature gradient of the detected temperatures with respect to the temperature gradient of the predicted temperatures is smaller than the predetermined abnormal state judging value.

Such a case that the CPU 21 judges in the above-described step e3 that the increasing time is shorter than the predetermined time period corresponds to such a case that the characteristic indicative of the abnormal state of the thermostat 13 cannot be completely grasped, but also the detecting precision for detecting the abnormal state of the thermostat 13 is low. In such a case, after the semiwarming-up state flag "1" has been set, the abnormal state detecting process operations as to the thermostat 13 shown in FIG. 3, FIG. 4, and FIG. 5 are carried out.

Concretely speaking, while the electric motor fan 12 is driven so as to blow wind with respect to the cooling water circulating path 15, under which condition, an abnormal state detecting operation of the thermostat 13 is carried out based upon both a detected cooling water temperature, and a cooling water temperature which has been predicted in response to a drive condition of the engine 17. The abnormal state detecting operation of the thermostat 13 may be carried out as follows. That is, for example, the CPU 21 calculates a difference between a detected temperature and a predicted temperature, and then, when the calculated temperature difference is smaller than a predetermined abnormal state judging value, the CPU 21 judges that the thermostat 13 is under an abnormal valve opening state. As a result, a difference between the cooling water temperature detected under such a condition that the electric motor fan 12 is driven and the predicted cooling water temperature is increased, and thus, a difference between the increasing degrees of the temperatures detected when the thermostat 13 is operated under normal state and abnormal state can become clear. As a consequence, in such a case that the CPU 21 judges that the detection precision of detecting the abnormal state of the thermostat 13 is low, since the abnormal state judging unit 22 performs the abnormal state detecting operation under such a condition that the electric motor fan 12 is driven, the abnormal state of the thermostat 13 can be detected in relatively high precision.

It should also be noted that the above-described embodiments are merely an exemplification of the present invention, and therefore, the arrangements may be modified within the technical scope of the present invention. For example, the above-described abnormal state detecting process operations as to the thermostat 13, as indicated in FIG. 3, FIG. 4, and FIG. 5, may be properly combined with each other.

As previously explained, in accordance with the present invention, since the electric motor fan is driven, the increasing degree of the detected cooling water temperature becomes largely different from the increasing degree of the predicted cooling water temperature, so that the difference between the temperature increasing degrees obtained when the thermostat is operated under normal state and also under abnormal state can become clear. As a consequence, the abnormal state judging unit only judges that the engine is under the semiwarming-up state, when the cooling water temperature detected while the prediction of the cooling water temperature is commenced may satisfy a predetermined temperature condition, and also merely judges as to whether or not the detected cooling water temperature is gradually increased, so that this abnormal judging unit can judge as to whether or not the thermostat is under the abnormal valve opening state. Accordingly, the abnormal state judging unit may readily detect the abnormal state of the thermostat even under the semiwarming-up state.

Also, in accordance with the present invention, the difference between the cooling water temperature detected under such a condition that the electric motor fan is driven and the predicted cooling water temperature becomes large, and thus, the difference between the temperature increasing degrees obtained when the thermostat is operated under normal state and also under abnormal state may become clear. As a consequence, in such a case that it is so judged that the detection precision for detecting the abnormal state of the thermostat is low, since the abnormal state is detected under such a condition that the electric motor fan is driven, the abnormal state of the thermostat can be detected in the relatively high precision.

Also, in accordance with the present invention, in such a case that the time period during which the cooling water temperature is reached to the predetermined temperature after the abnormal state detecting operation has been commenced is shorter than, or equal to the predetermined time, the abnormal state is again detected under such a condition that the electric motor fan is driven. As a result, the detecting precision can be improved, and the abnormal state of the thermostat can be detected in the relatively high precision.

Also, in accordance with the present invention, if the difference between the temperature gradient of the detected cooling water temperature and the temperature gradient of the predicted cooling water temperature is calculated by driving the electric motor fan, then the difference between the temperature gradients becomes large. Thus, the differences between the temperature gradients calculated when the thermostat is operated under normal operation and abnormal operation can become clear. As a consequence, when the cooling water temperature detected while the predicting operation of the cooling water temperature is commenced can satisfy the predetermined temperature condition, the abnormal state judging unit only judges that the engine is under the semiwarming-up state, and merely judges as to whether or not the difference the temperature gradient of the detected cooling water temperature and the temperature gradient of the predicted cooling water temperature is smaller than the predetermined abnormal state judging value, so that this abnormal judging unit can judge as to whether or not the thermostat is under the abnormal valve opening state. Accordingly, the abnormal state judging unit may readily detect the abnormal state of the thermostat even under the semiwarming-up state.

Also, in accordance with the present invention, the difference between the detected cooling water temperature and the predicted cooling water temperature is repeatedly calculated plural times, the averaged value of these calculated temperature differences is calculated, and then, the abnormal state detecting operation of the thermostat is carried out by comparing the averaged value of the temperature difference with the predetermined value. As a consequence, the abnormal state of the thermostat can be detected in the relatively high precision, as compared with such a case that only one of the differences between the detected cooling water temperatures and the predicted cooling water temperatures is calculated, and then, this one calculated temperature difference is compared with the predetermined value.

Also, in accordance with the present invention, the difference between the temperature gradient of the detected cooling water temperature and the temperature gradient of the predicted cooling water temperature is repeatedly calculated plural times, the averaged value of these calculated temperature gradients is calculated, and then the abnormal state detecting operation of the thermostat is carried out by comparing the averaged value of the differences between the temperature gradients with the predetermined value. As a consequence, the abnormal state of the thermostat can be detected in the relatively high precision, as compared with such a case that only one of the differences between the temperature gradients of the detected cooling water temperatures and the temperature gradients of the predicted cooling water temperatures is calculated, and then, this one calculated temperature gradient difference is compared with the predetermined value.

Also, in accordance with the present invention, when the electric motor fan is driven in the intermittent manner under predetermined condition, the abnormal state of the thermostat can be detected in the relatively high precision, as compared with such a case that the electric motor fan is simply driven only for a predetermined time period. Also, since the electric motor fan is intermittently driven under the predetermined condition, the abnormal state judging unit may readily detect the abnormal state of the thermostat even under the semiwarming-up state.

Also, in accordance with the present invention, since the execution of the abnormal state judging process operation of the thermostat is brought into the waiting state until the predetermined time has elapsed, both the cooling water present on the engine side and the cooling water present on the radiator side are circulated, so that the cooling water temperature within the circulating path can be maintained at a constant temperature. As a consequence, the abnormal state of the thermostat can be detected in the relative high precision, as compared with such a case that the abnormal state of the thermostat is detected under such a condition that there is a difference between the cooling water temperature within the engine-sided circulating path and the cooling water temperature within the radiator-sided circulating path before the predetermined time has passed.

Also, in accordance with the present invention, since the rotation speed of the electric motor fan is varied in response to the operating condition of the engine, for example, the traveling speed of the vehicle, the electric load given to the electric motor fan, for example, the load given to the battery can be reduced.

Also, in accordance with the present invention, since the electric motor fan blows wind with respect to the radiator, the heat radiating effect of the radiator can be increased, so that cooling effects achieved by the cooling water contained in the radiator may be emphasized. As a consequence, the cooling effects as to the entire cooling water which is circulated through the circulating path can be emphasized.

What is claimed is:

1. A thermostat abnormal state detecting apparatus for detecting an abnormal state of a thermostat which is provided in a circulating path for cooling water within an engine based upon both a detected cooling water temperature and a cooling water temperature predicted by a driving condition of the engine, wherein:

when said detected cooling water temperature is within a predetermined range and said abnormal state detecting is commenced on the basis of the detected cooling water temperature and the predicted cooling water temperature, an electric motor fan for blowing wind with respect to said circulating path is driven during the abnormal state detecting.

2. The thermostat abnormal state detecting apparatus according to claim 1, wherein:

a temperature gradient of said detected cooling water temperature is calculated based upon a temporal change in said detected cooling water temperature;

a temperature gradient of said predicted cooling water temperature is calculated based upon a temporal change in said predicted cooling water temperature;

a difference between said calculated temperature gradients is calculated; and when said calculated difference between the temperature gradients is smaller than a predetermined value, said thermostat abnormal state detecting apparatus judges that said thermostat is brought into an abnormal valve opening state.

3. The thermostat abnormal state detecting apparatus according to claim 2, wherein when the cooling water temperature detected while said engine is started satisfies said predetermined temperature condition, said thermostat abnormal state judging apparatus judges as to whether or not said thermostat is under said abnormal valve opening state after a predetermined time has elapsed.

4. The thermostat abnormal state detecting apparatus according to claim 1, wherein:

an averaged value of differences between a plurality of said detected cooling water temperatures and a plurality of said predicted cooling water temperatures is calculated; and when the calculated averaged value is smaller than a predetermined value, said thermostat abnormal state detecting apparatus judges that said thermostat is brought into an abnormal valve opening state.

5. The thermostat abnormal state detecting apparatus according to claim 1, wherein:

a temperature gradient of said detected cooling water temperature is calculated based upon a temporal change in said detected cooling water temperature;

a temperature gradient of said predicted cooling water temperature is calculated based upon a temporal change in said predicted cooling water temperature;

an averaged value of differences between said calculated temperature gradients is calculated; and when said calculated averaged value of the differences between the temperature gradients is smaller than a predetermined value, said thermostat abnormal state detecting apparatus judges that said thermostat is brought into an abnormal valve opening state.

6. The thermostat abnormal state detecting apparatus according to claim 1, wherein after said electric motor fan has been driven in an intermittent manner under a predetermined condition, said thermostat abnormal state detecting apparatus judges as to whether or not said thermostat is under an abnormal valve opening state.

7. The thermostat abnormal state detecting apparatus according to claim 1, wherein a rotation speed of said electric motor fan is changed in response to the driving condition of said engine.

8. The thermostat abnormal state detecting apparatus according to claim 1, wherein said electric motor fan blows wind with respect to a radiator which is provided in said circulating path.

9. A thermostat abnormal state detecting apparatus for detecting an abnormal state of a thermostat which is provided in a circulating path for cooling water within an engine based upon both a detected cooling water temperature and a cooling water temperature predicted by a driving condition of the engine, wherein in such a case that it is so judged that detection precision achieved when said abnormal state detecting operation is carried out is low, under such a condition that an electric motor fan for blowing wind with respect to said circulating path is driven during the abnormal state detecting operation, the abnormal state detecting operation as to the thermostat is carried out based upon both the detected cooling water temperature and the cooling water temperature predicted by the driving condition of the engine.

10. The thermostat abnormal state detecting apparatus according to claim 9, wherein such a case that it is so judged that said detection precision is low corresponds to a case that a time period defined by that the cooling water temperature is reached to a predetermined temperature after the abnormal state detecting operation has been commenced is shorter than, or equal to a predetermined time period.

11. An electronic control apparatus equipped with a thermostat abnormal state judging unit for detecting an abnormal state of a thermostat which is provided in a circulating path for cooling water within an engine based upon both a detected cooling water temperature and a cooling water temperature predicted by a driving condition of the engine, wherein:

when said detected cooling water temperature is within a predetermined range and said abnormal state detecting is commenced on the basis of the detected cooling water temperature and the predicted cooling water temperature, an electric motor fan for blowing wind with respect to said circulating path is driven during the abnormal state detecting.

12. The electronic control apparatus equipped with a thermostat abnormal state judging unit according to claim 11, wherein:

a temperature gradient of said detected cooling water temperature is calculated based upon a temporal change in said detected cooling water temperature; a temperature gradient of said predicted cooling water temperature is calculated based upon a temporal change in said predicted cooling water temperature;

a difference between said calculated temperature gradients is calculated; and when said calculated difference between the temperature gradients is smaller than a predetermined value, said thermostat abnormal state detecting unit judges that said thermostat is brought into an abnormal valve opening state.

13. The electronic control apparatus equipped with a thermostat abnormal state judging unit according to claim 12, wherein when the cooling water temperature detected while said engine is started satisfies said predetermined temperature condition, said thermostat abnormal state judging unit judges as to whether or not said thermostat is under said abnormal valve opening state after a predetermined time has elapsed.

14. The electronic control apparatus equipped with a thermostat abnormal state judging unit according to claim 11, wherein:

an averaged value of differences between a plurality of said detected cooling water temperatures and a plurality of said predicted cooling water temperatures is calculated; and when the calculated averaged value is smaller than a predetermined value, said thermostat abnormal state detecting apparatus judges that said thermostat is brought into an abnormal valve opening state.

15. The electronic control apparatus equipped with a thermostat abnormal state judging unit according to claim 11, wherein:

a temperature gradient of said detected cooling water temperature is calculated based upon a temporal change in said detected cooling water temperature;

a temperature gradient of said predicted cooling water temperature is calculated based upon a temporal change in said predicted cooling water temperature;

an averaged value of differences between said calculated temperature gradients is calculated; and when said calculated averaged value of the differences between the temperature gradients is smaller than a predetermined value, said thermostat abnormal state detecting unit judges that said thermostat is brought into an abnormal valve opening state.

16. The electronic control apparatus equipped with a thermostat abnormal state judging unit according to claim 11, wherein after said electric motor fan has been driven in an intermittent manner under a predetermined condition, said thermostat abnormal state detecting unit judges as to whether or not said thermostat is under an abnormal valve opening state.

17. The electronic control apparatus equipped with a thermostat abnormal state judging unit according to claim 11, wherein a rotation speed of said electric motor fan is changed in response to the driving condition of said engine.

18. The electronic control apparatus equipped with a thermostat abnormal state judging unit according to claim 11, wherein said electric motor fan blows wind with respect to a radiator which is provided in said circulating path.

19. An electronic control apparatus equipped with a thermostat abnormal state judging unit for detecting an abnormal state of a thermostat which is provided in a circulating path for cooling water within an engine based upon both a detected cooling water temperature and a cooling water temperature predicted by a driving condition of the engine, wherein in such a case that it is so judged that detection precision achieved when said abnormal state detecting operation is carried out is low, under such a condition that an electric motor fan for blowing wind with respect to said circulating path is driven during the abnormal state detecting operation, the abnormal state detecting operation as to the thermostat is carried out based upon both the detected cooling water temperature and the cooling water temperature predicted by the driving condition of the engine.

20. The electronic control apparatus equipped with a thermostat abnormal state judging unit according to claim 19, wherein such a case that it is so judged that said detection precision is low corresponds to a case that a time period defined by that the cooling water temperature is reached to a predetermined temperature after the abnormal state detecting operation has been commenced is shorter than, or equal to a predetermined time period.

* * * * *